US007410277B1

(12) United States Patent
Leddusire

(10) Patent No.: US 7,410,277 B1
(45) Date of Patent: Aug. 12, 2008

(54) DEVICE FOR SECURING A SHADE TO A LIGHT FIXTURE

(75) Inventor: Ron Leddusire, Seattle, WA (US)

(73) Assignee: Dolan Northwest, LLC, Portland, OR (US)

( * ) Notice: Subject to any disclaimer, the term of this patent is extended or adjusted under 35 U.S.C. 154(b) by 290 days.

(21) Appl. No.: 11/344,038

(22) Filed: Jan. 30, 2006

Related U.S. Application Data

(63) Continuation-in-part of application No. 10/722,748, filed on Nov. 26, 2003, now Pat. No. 7,008,083.

(51) Int. Cl.
*F21V 17/00* (2006.01)
*F21V 17/08* (2006.01)

(52) U.S. Cl. ..... 362/417; 362/452; 362/412; 362/351; 362/356

(58) Field of Classification Search ..... 362/417, 362/452, 412, 351, 355–357, 453, 454, 515, 362/421, 528, 448, 433
See application file for complete search history.

(56) References Cited

U.S. PATENT DOCUMENTS 1,974,947 A * 9/1934 Berger ..... 362/452
2,495,209 A * 1/1950 Chilo ..... 362/452
2,532,821 A * 12/1950 Rosenfeld ..... 362/412
2,706,771 A * 4/1955 Berger ..... 362/452
2,745,002 A 5/1956 Hoffman
2,805,329 A * 9/1957 Golden ..... 362/452
3,016,455 A * 1/1962 Goldfine ..... 362/452
4,414,618 A 11/1983 Jacobson
4,493,011 A 1/1985 Spector
4,633,378 A 12/1986 Reisman
4,827,382 A 5/1989 Feliks
5,392,204 A * 2/1995 Schumaker ..... 362/355
6,227,680 B1 5/2001 Arndt

* cited by examiner

*Primary Examiner*—Bao Q Truong
(74) *Attorney, Agent, or Firm*—Marger Johnson & McCollom, P.C.

(57) ABSTRACT

A device includes a bolt, a nut, and a coupling. The bolt includes a head and a shaft, and the bolt has a first longitudinal axis that passes through a center of the head and the shaft. The shaft has a first set of threads that are disposed on a radially outer surface of the shaft, and the head has a substantially convex surface. The nut has a second set of threads that are disposed on a radially inner surface of the nut, and the second set of threads is structured to threadably engage the first set of threads. The coupling is structured to attach the bolt to an object, and the coupling and the nut are structured to maintain the substantially convex surface of the head in an abutting relationship with a substantially concave surface of the object.

16 Claims, 23 Drawing Sheets

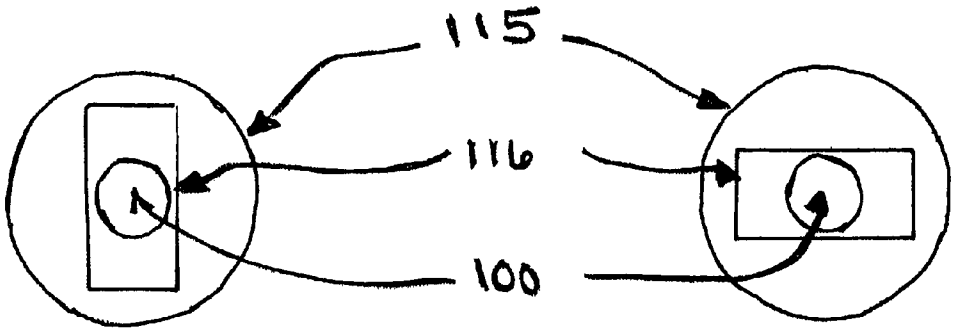
Fig 16A
Fig 16B
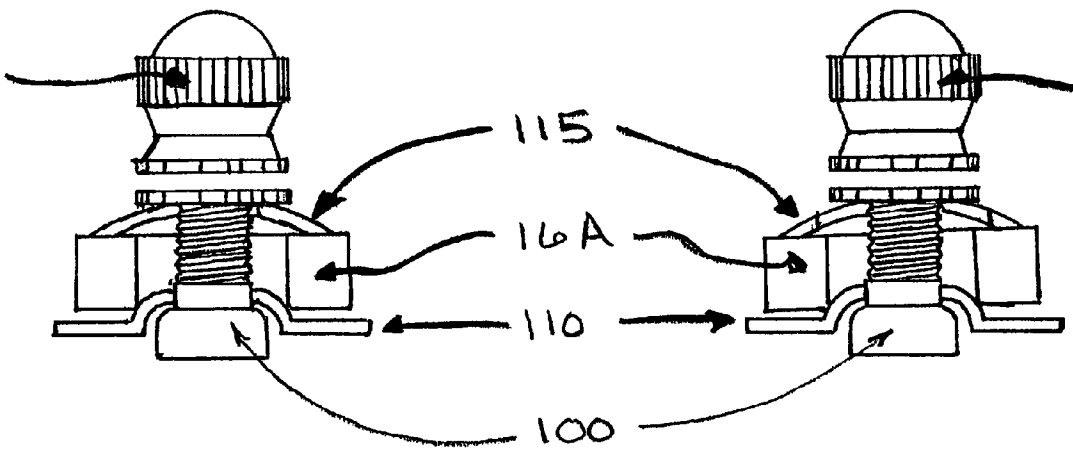
Fig 17A
Fig 17B

200

200

300

DEVICE FOR SECURING A SHADE TO A LIGHT FIXTURE

CROSS REFERENCE TO RELATED APPLICATIONS

This application is a continuation-in-part of U.S. patent application Ser. No. 10/722,748, which was filed on 26 Nov. 2003, now U.S. Pat. No. 7,008,083 B2, issued Mar. 7, 2006, which is incorporated by reference in its entirety.

BACKGROUND OF THE INVENTION

1. Technical Field of the Invention

This disclosure relates generally to lighting systems, components, and methods and more particularly to a device for securing a shade to a light fixture.

2. Description of the Related Art

FIGS. 1-5 are diagrams that illustrate the industry standard device for attaching a shade to a lighting fixture, in this case a lamp. Like reference numerals refer to like parts throughout. With reference to FIGS. 1-5, a base unit 2 of the lamp supports a switch/socket assembly 4 and a harp 8. A light bulb 6 may be inserted and removed from the switch/socket assembly 4 by screwing the base of the light bulb into the socket. A flattened portion at the top of the harp 8 supports a lamp washer 10 and a finial support 12.

The lamp washer 10 is typically crimped to the shaft of the harp 8 at two positions. Prior to crimping, a threaded end of the finial support 12 is inserted through a central hole in the middle of the lamp washer 10. The other end of the finial support 12 is flattened and keyed to engage the shaft of the harp 8. Consequently, when the lamp washer is crimped to the shaft of the harp 8, the threaded end of the finial support 12 is positioned perpendicularly to the shaft of the harp 8. The lamp washer 10 and the finial support 12 are rigidly connected. That is, a force applied to the finial support 12 causes the lamp washer 10 to move and vice versa. Additionally, the keyed end of the finial support 12 allows one to screw and unscrew a finial 14 (see FIG. 4) from the finial support 12 without causing the finial support 12 to rotate.

FIG. 3 illustrates a top, front, and side view of the harp 8, the lamp washer 10, and the finial support 12. The dotted lines in FIGS. 2 and 3 indicate that the lamp washer 10, and in turn the finial support 12, may rotate around the shaft of the harp 8 if enough rotational force is applied.

A rotational force is typically applied when there is a shade 16 attached to the lamp fixture by a finial 14, as shown in FIG. 4. Objects, pets, or people may physically contact the shade 16, thereby causing the shade 16, the finial 14, the finial support 12, and the lamp washer 10 to rotate around the axis of the harp 8, as illustrated in FIG. 5. Of course, if force is applied to the shade 16 in a direction parallel to the axis of the harp 8, rotation is prevented because the lamp washer 10 may only rotate in directions perpendicular to the harp axis. Thus, in these situations, the entire lamp tends to move.

Neither situation outlined above is desirable. In the first case, the shade 16 may stop in a position that is too close, or even touching, a hot light bulb 6. This is frequently the cause of many fires. In the second case, the shade 16, the harp 8, or the entire lamp may be damaged if the force applied to the shade is sufficient to overturn the lamp.

Furthermore, the more the shade 16 is jostled over time, the looser the connection between the lamp washer 10 and the harp 8 becomes. This is due to the fact that metal at the crimped portion of the lamp washer 10 is in direct contact with the harp 8. Thus, the metal will start to wear down with each rotation of the lamp washer 10, making the overall connection less stable.

Embodiments of the invention address these and other disadvantages of the conventional art.

BRIEF DESCRIPTION OF THE DRAWINGS

FIGS. 16A and 16B are top-view diagrams illustrating an additional component for a shade leveler according to other embodiments of the invention.

FIGS. 17A and 17B are side-view diagrams illustrating how the additional component of FIGS. 16A and 16B is assembled in relationship to other components of the shade leveler.

DETAILED DESCRIPTION

Figures 1, 2:
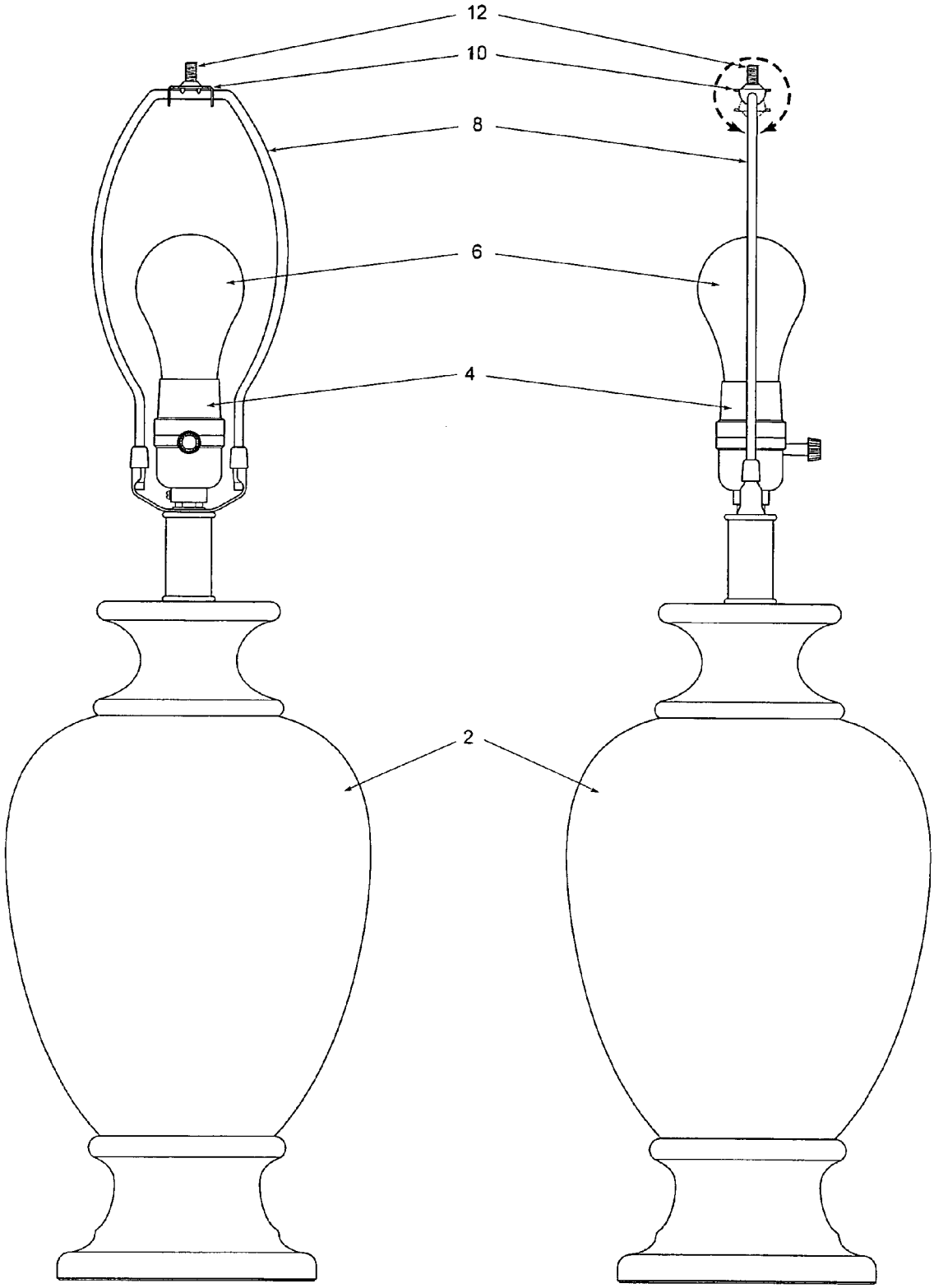
FIG. 1 (Prior art)
FIG. 2 (Prior art)
FIGS. 1-5 are diagrams illustrating a conventional lamp shade attachment device.

In the following detailed description, numerous exemplary embodiments of the invention are described. These embodiments are not limiting, but rather illustrate concepts of the invention that may be applied in many different embodiments. Thus, the scope of the invention should only be limited by the language of the appended claims. Throughout this detailed description, like reference numerals in the FIGURES refer to like elements.

Figure 6A:
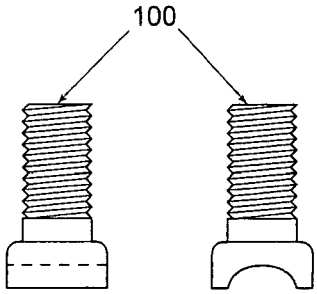
FIGS. 6A and 6B are diagrams illustrating the components of a shade leveler according to some embodiments of the invention.
Figure 6B:
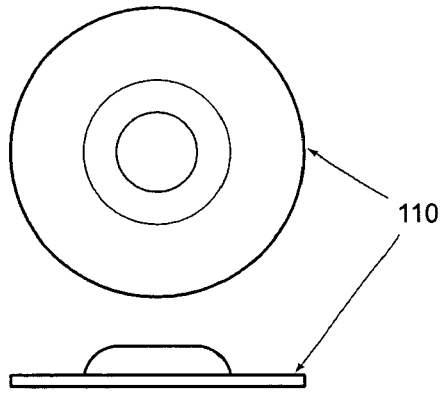

FIGS. 6A and 6B are diagrams illustrating the components of a shade leveler according to some embodiments of the invention.

Figure 4:
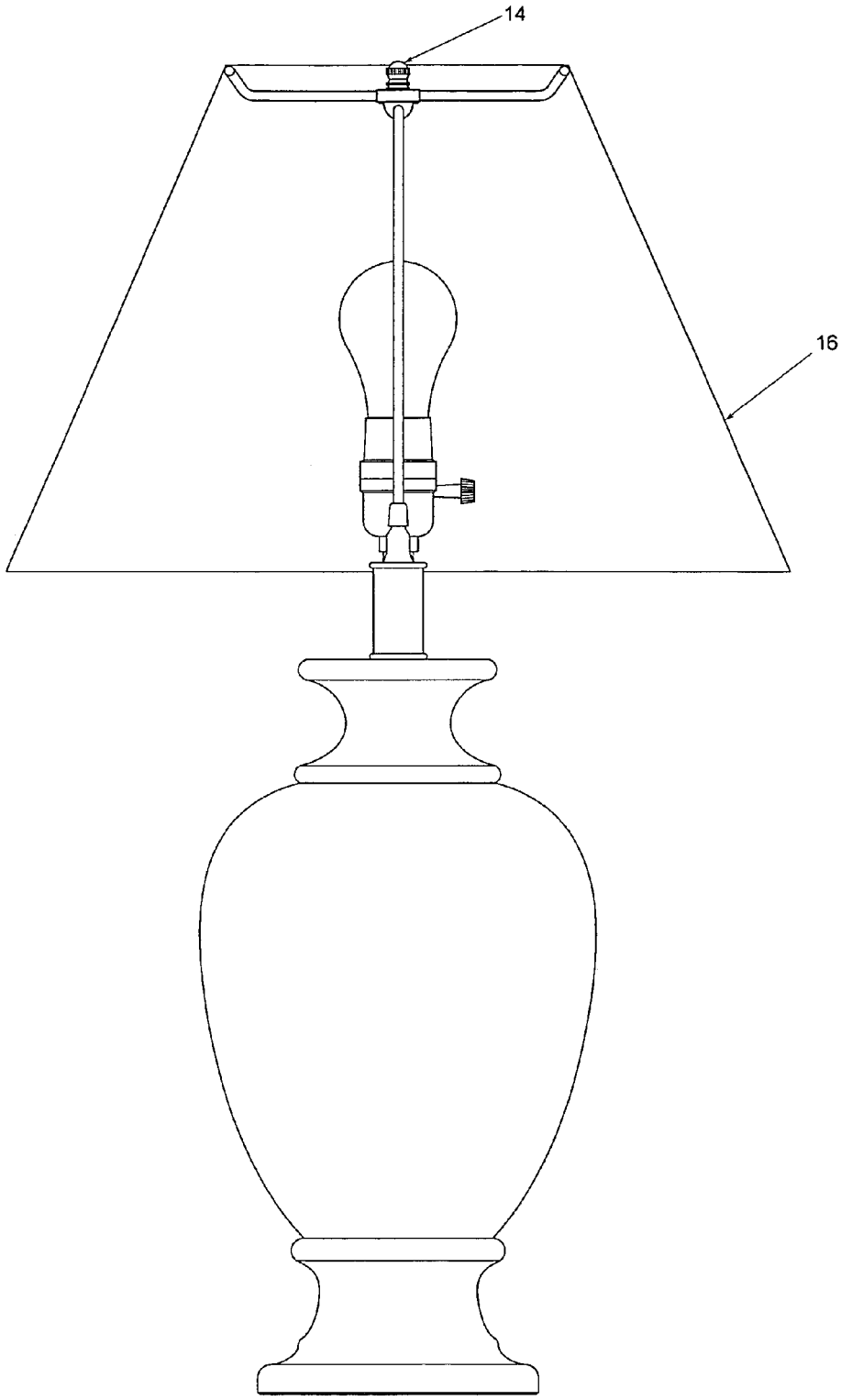
FIG. 4 (Prior art)
Figure 5:
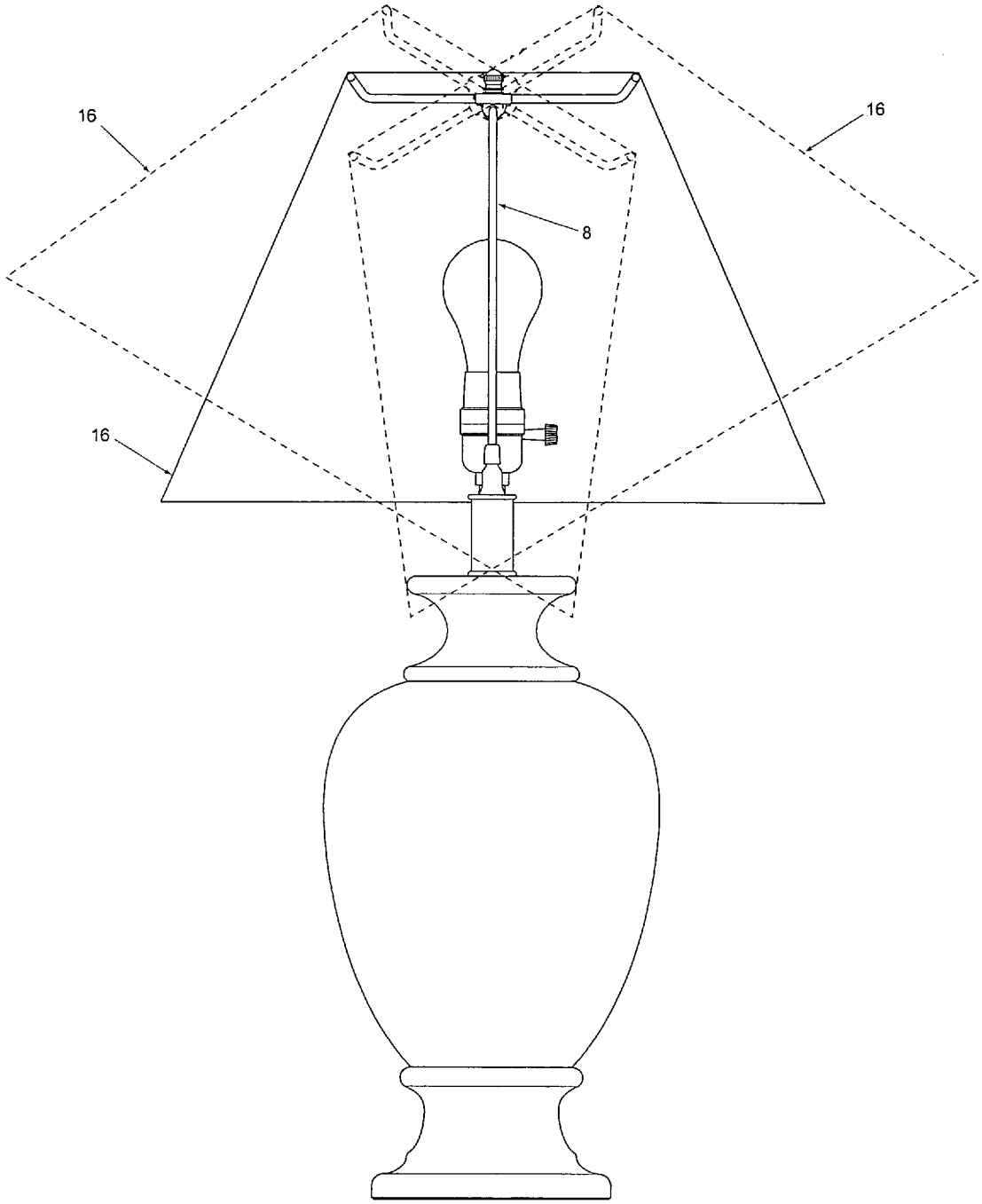
FIG. 5 (Prior art)

FIG. 6A is a diagram with two side views of a post 100. The bottom portion of the post 100 has a groove that corresponds to the curved shaft of the harp 8 (see FIGS. 7A and 7B). This grooved, or keyed, portion of the post 100 allows a finial 14 (see FIG. 4) to be screwed or unscrewed from the threads of the post without causing the post to rotate.

FIG. 6B is a diagram with a top view and a side view of a shade leveling ring 110. As seen in FIG. 6B, there is a hole in the central portion of the shade leveling ring 110. The inner, central portion of the shade leveling ring 110 is raised with respect to the outermost portion of the shade leveling ring 110.

The post 100 and the shade leveling ring 110 may be manufactured from any number of conventionally known materials such as metals, plastics, ceramics, or wood.

Figure 7A:
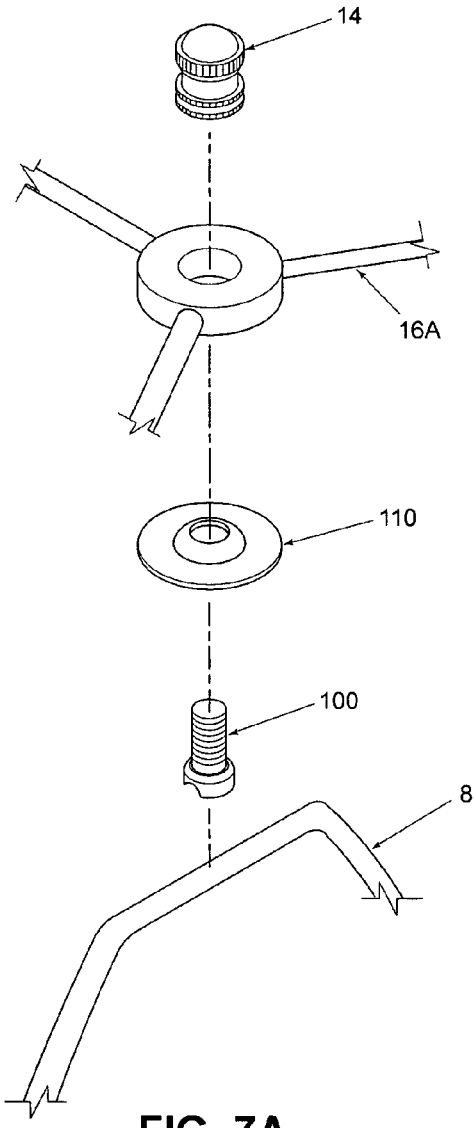
FIGS. 7A and 7B are diagrams illustrating how the shade leveler of FIG. 6 fits together in relationship to conventional lamp fixture components.
Figure 7B:
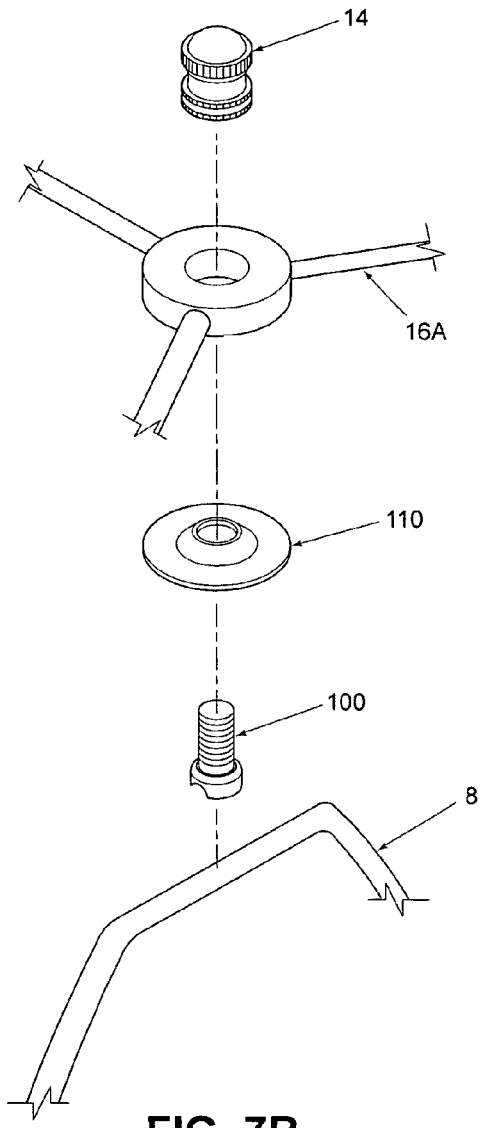

FIGS. 7A and 7B are diagrams illustrating how the shade leveler of FIG. 6 fits together in relationship to conventional lamp fixture components. The grooved end of the post 100 is placed against the horizontal portion of the harp 8. The shade leveling ring 110 is then placed over the post 100 so that the threaded end of the post goes through the hole in the shade leveling ring. Next, a shade bracket 16A from a conventional shade 16 (see FIG. 4) is laid over the shade leveling ring 110, such that the threaded end of the post 100 goes through the hole in the shade bracket 16A. Finally, the finial 14 is screwed onto the threaded end of the post 100. The finial 14 holds the shade bracket 16A against the shade leveling ring 110 and prevents the shade bracket 16A (and thus, the shade 16) from falling off the threaded end of the post 100.

The difference between FIGS. 7A and 7B is that in FIG. 7A the shade leveling ring 110 has a dome-shaped profile that is completely smooth while the shade leveling ring 110 of FIG. 7A has a dome-shaped profile with a raised edge at the uppermost portion of the dome.

Figure 8A:
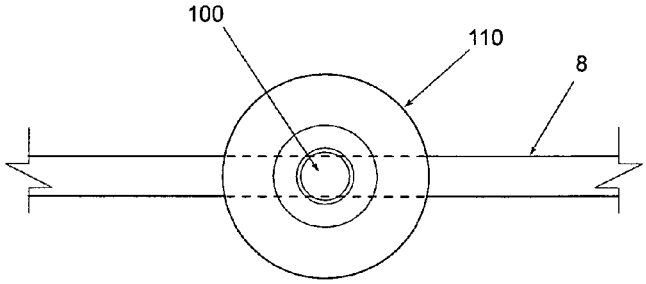
FIGS. 8A, 8B, and 8C are top, front, and side-view diagrams, respectively, which illustrate how the shade leveler of FIG. 6 is assembled in relationship to a conventional harp.
Figure 8B:
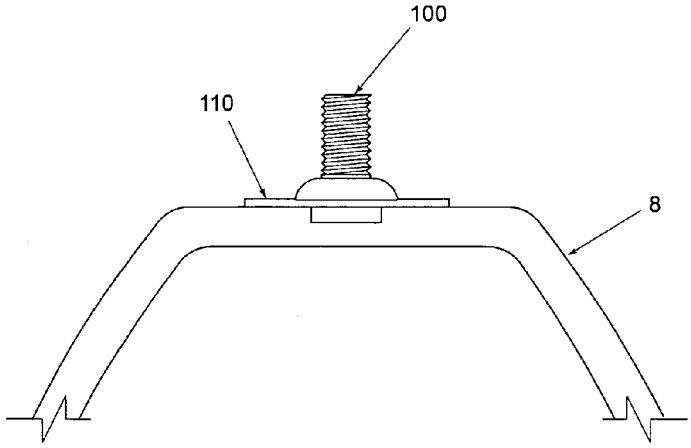
Figure 8C:
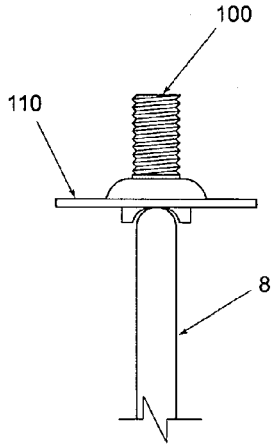

FIGS. 8A, 8B, and 8C are top, front, and side-view diagrams, respectively, which illustrate how shade levelers in accordance with some embodiments of the invention are assembled in relationship to a conventional harp. As seen in FIGS. 8A-8C, a portion of the flat, outer portion of the shade leveling ring 110 is in contact with the harp 8. At this junction between the harp 8 and the shade leveling ring 110, the shade leveling ring 110 is affixed to the harp 8. The shade leveling ring 110 may be permanently affixed to the harp 8 by any number of conventional methods, such as spot welding. The shade leveling ring 110 may also be detachably affixed to the harp 8 using any number of conventional methods, such as adhesive or screws. This would allow a damaged harp 8 or shade leveling ring 110 to be separately replaced.

Figure 9A:
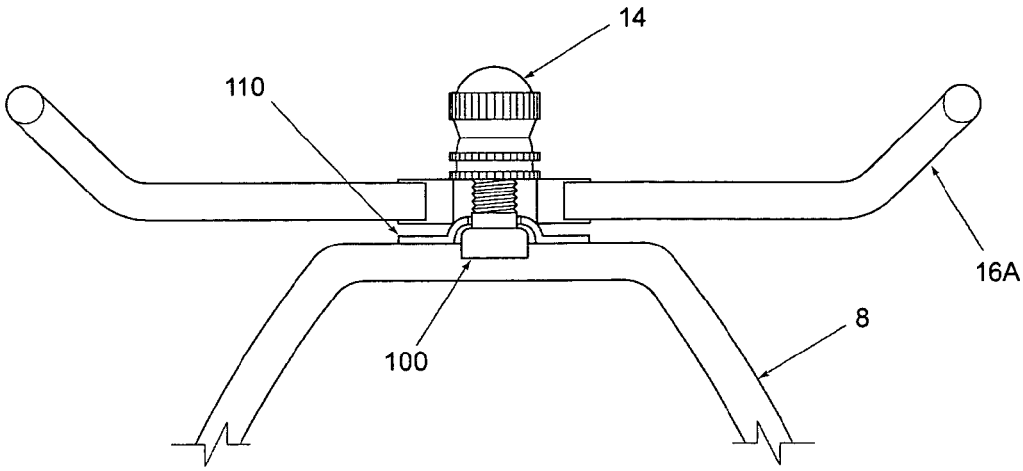
FIGS. 9A and 9B are front and side-view diagrams, respectively, illustrating how the shade leveler of FIG. 6 is positioned after the components shown in FIG. 7A are assembled.
Figure 9B:
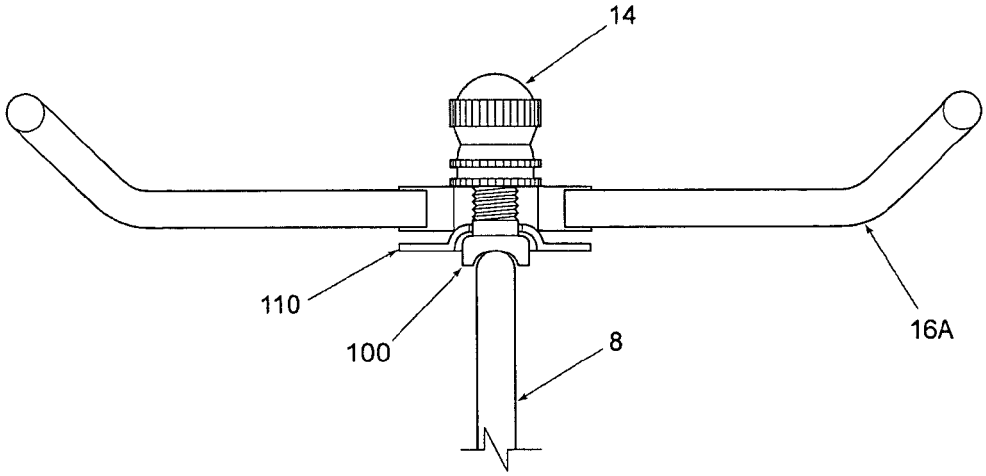

FIGS. 9A and 9B are front and side-view diagrams, respectively, illustrating how the shade leveler of FIG. 6 is positioned after the components shown in FIG. 7A are assembled. It is easily seen in FIGS. 9A and 9B how the dome-shaped portion of the shade leveling ring 110 contacts the circular edge on the bottom of the shade bracket 16A. When the finial 14 is tightened, the grooved portion of the post 100 contacts the harp 8 and prevents the post from rotating in the same direction that the finial is tightened. Similarly, the finial 14 may be loosened without rotating the post 100. However, the grooved portion of the post 100 is only loosely held against the harp 8 by the shade leveling ring 110. In other words, no portion of the post 100 is rigidly connected to the harp 8. Tightening the finial 14 only serves to hold the circular edge on the bottom of the shade bracket 16A more tightly to the dome-shaped portion of the shade leveling ring 110.

Figure 10A:
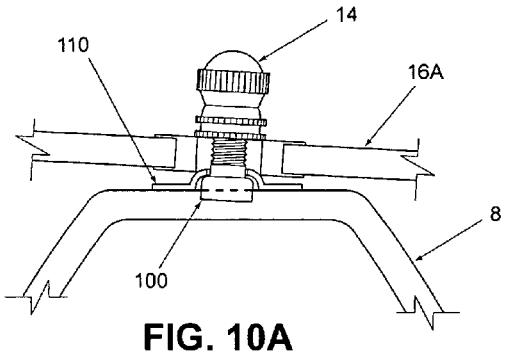
FIGS. 10A, 10B, 10C, and 10D are diagrams illustrating the operation of the shade leveler of FIG. 6 when a force is applied to a conventional shade that is attached to it.
Figure 10B:
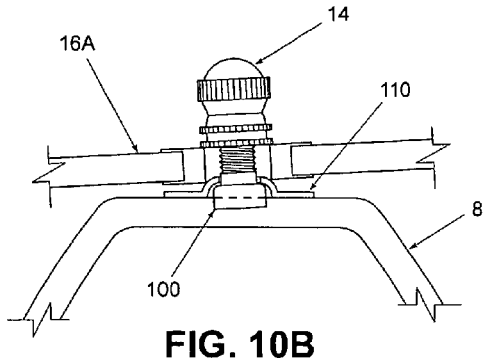
Figure 10C:
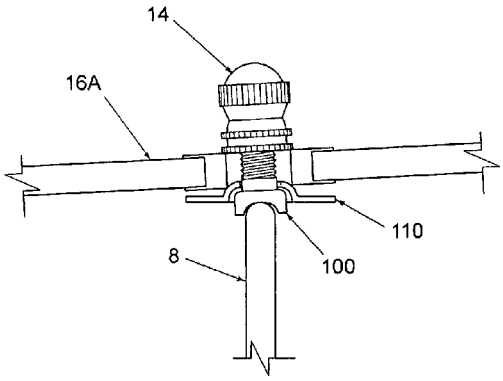
Figure 10D:
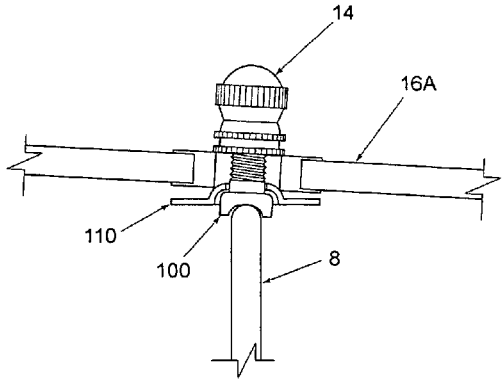

FIGS. 10A, 10B, 10C, and 10D are diagrams illustrating the operation of the shade leveler of FIG. 6 when a force is applied to a conventional shade 16 that is attached to it. This occurs when some object, pet, or person bumps or contacts the shade 16 (see FIG. 4). FIGS. 10A and 10B are front-view diagrams, and FIGS. 10C and 10D are side-view diagrams.

Figure 3A:
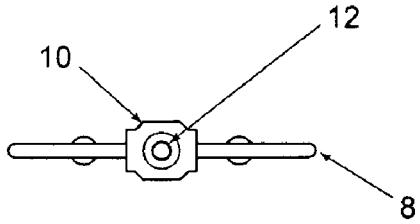
FIG. 3A (Prior art)
Figure 3B:
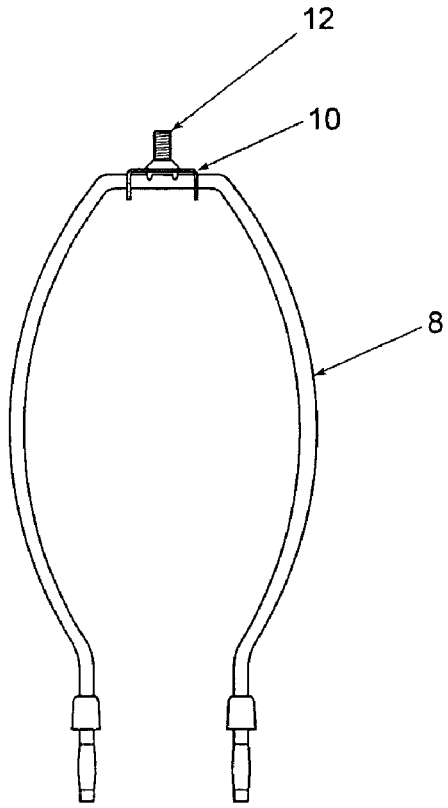
FIG. 3B (Prior art)
Figure 3C:
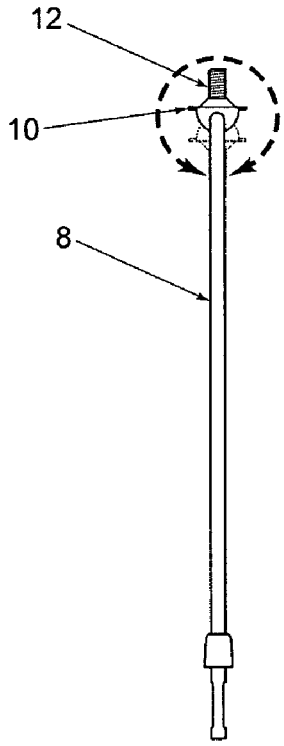
FIG. 3C (Prior art)

As seen in FIGS. 10A-10D, when a force is applied to the shade bracket 16A it causes the shade bracket 16A, the finial 14, and the post 100 to move in relationship to the shade leveling ring 110 and the harp 8. The dome-shaped portion of the shade leveling ring 110 allows the shade bracket 16A to slide over the dome in the direction of any applied force. This is a significant improvement over conventional devices, where movement of the shade 16 is limited to a rotational direction about the axis of the harp 8 (see FIGS. 2 and 3). With the dome-shaped profile of the shade leveling ring 110, force can be applied in all directions to the shade 16 and the shade 16 will move in that direction.

Furthermore, as mentioned above, only a tiny portion of the shade bracket 16A is in contact with the shade leveling ring 110. Thus, regardless of how tight the finial 14 is screwed onto the post 100, it is relatively easy to move the shade bracket 16A over the dome-shaped profile of the shade leveling ring 110.

In fact, when the finial 14 is merely tightened to the point where it prevents the shade bracket 16A from falling off the post 100, an additional advantage is achieved. The equally distributed weight of the shade 16 will cause the shade bracket 16A to seek a naturally balanced point on the shade leveling ring 110. Thus, if the shade 16 is bumped, the dome-shaped profile of the shade leveling ring 110 imparts a self-leveling action.

Figure 11:
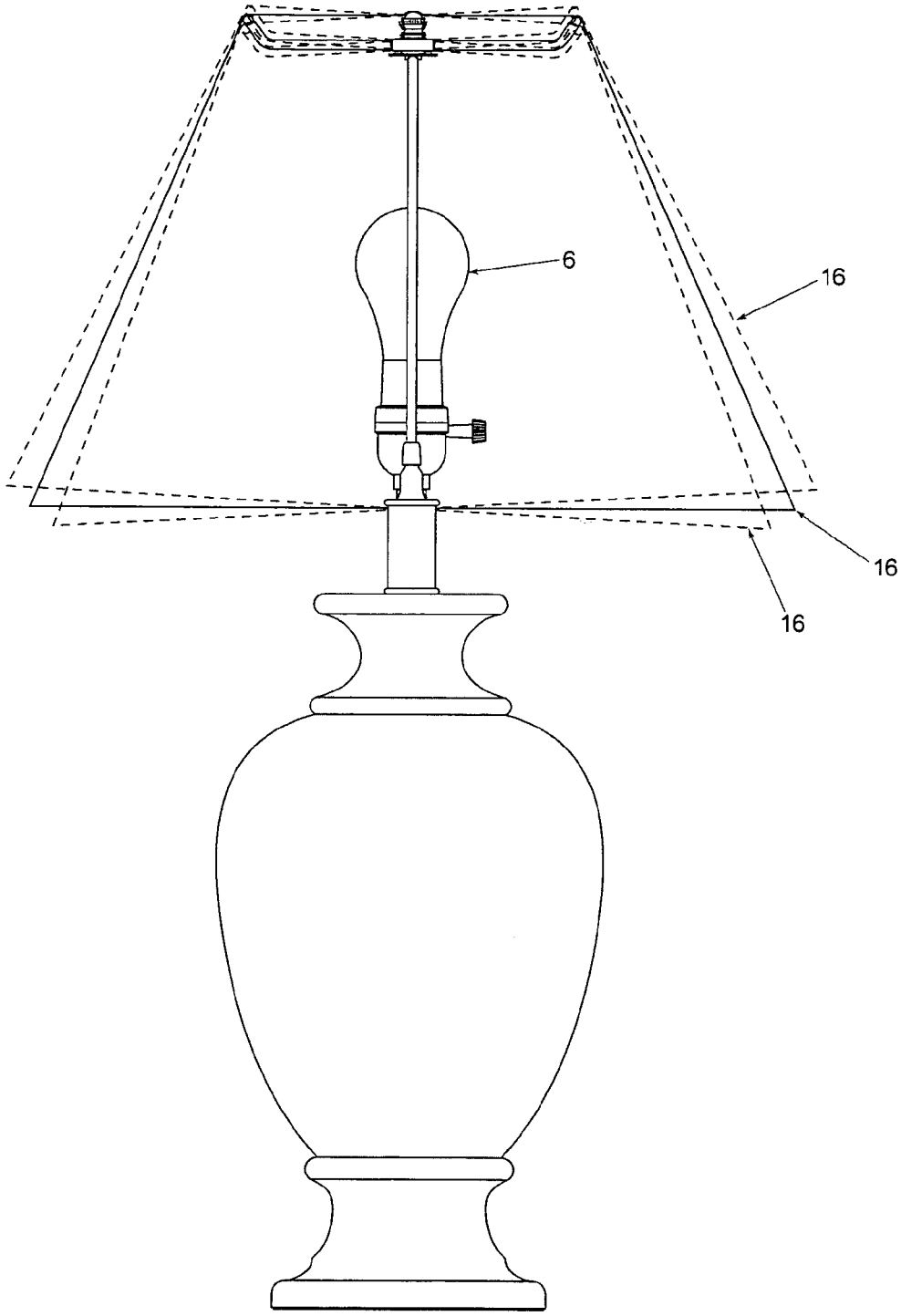
FIG. 11 is a diagram illustrating how the shade leveler of FIG. 6 restricts the movement of a conventional shade attached to a conventional lamp fixture.

Of course, at some point further movement of the shade bracket 16A, the finial 14, and the post 100 in relation to the harp 8 and the shade leveling ring 110 will not be possible due to the shade bracket 16A or the post 100 impinging against the shade leveling ring 110. Consequently, unlike the conventional shade attachment device, the shade 16 will never come to rest in a position where it is too close to the light bulb 6, as shown in FIG. 11.

Although the embodiments of the invention described above possess a shade leveling ring 110 with a dome-shaped profile, many other profiles and shapes are possible depending on the range of motion that the designer wishes to impart to the shade bracket 16A.

Figure 12A:
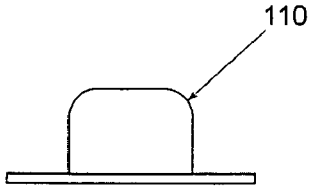
FIGS. 12A and 12B are diagrams illustrating shade leveling rings according to other embodiments of the invention.

For example, raising the dome-shaped portion further from the flattened portion would result in the shade leveling ring 110 shown in FIG. 12A. This design would allow the shade bracket 16A (not shown) a greater degree of movement because of the additional clearance between the shade bracket 16A and the flattened portion of the shade leveling ring 110. Of course, the length of the post 100 would also need to be increased.

Figure 12B:
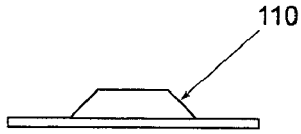

FIG. 12B is a shade leveling ring according to other embodiments of the invention. In this design, the raised portion of the shade leveling ring 110 is substantially cone-shaped.

Other embodiments of the invention may alter the range of motion of the shade bracket 16A by having a shade leveling ring 110 that has a larger diameter hole than the diameter of the post 100. Still other embodiments of the invention may have a shade leveling ring that has a central hole that is not circular, but some other shape that allows more movement in certain directions and less movement in others. For example, the central hole may be substantially star-shaped or cross-shaped.

Figure 13A:
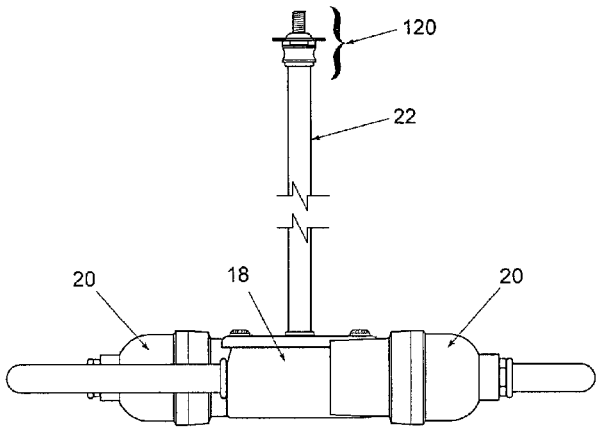
FIGS. 13A and 13B are front and side-view diagrams, respectively, that illustrate other embodiments of the invention that are used with a conventional S-cluster.
Figure 13B:
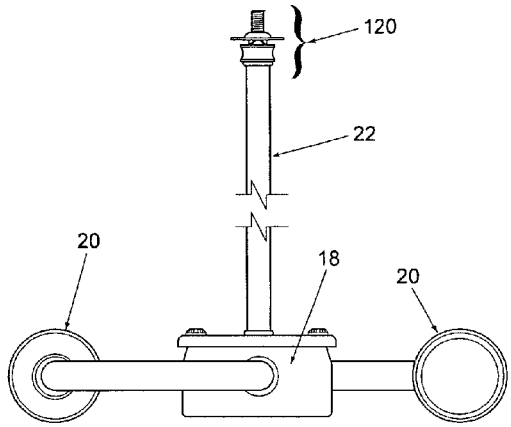

FIGS. 13A and 13B are front and side-view diagrams, respectively, that illustrate other embodiments of the invention that are used with a conventional S-cluster 18. An S-cluster 18 has two sockets 20 that are used to hold lightbulbs (not shown). The S-cluster 18 also includes a riser 22. The shade leveler 120 according to these embodiments of the invention sits atop the riser 22.

Figure 14A:
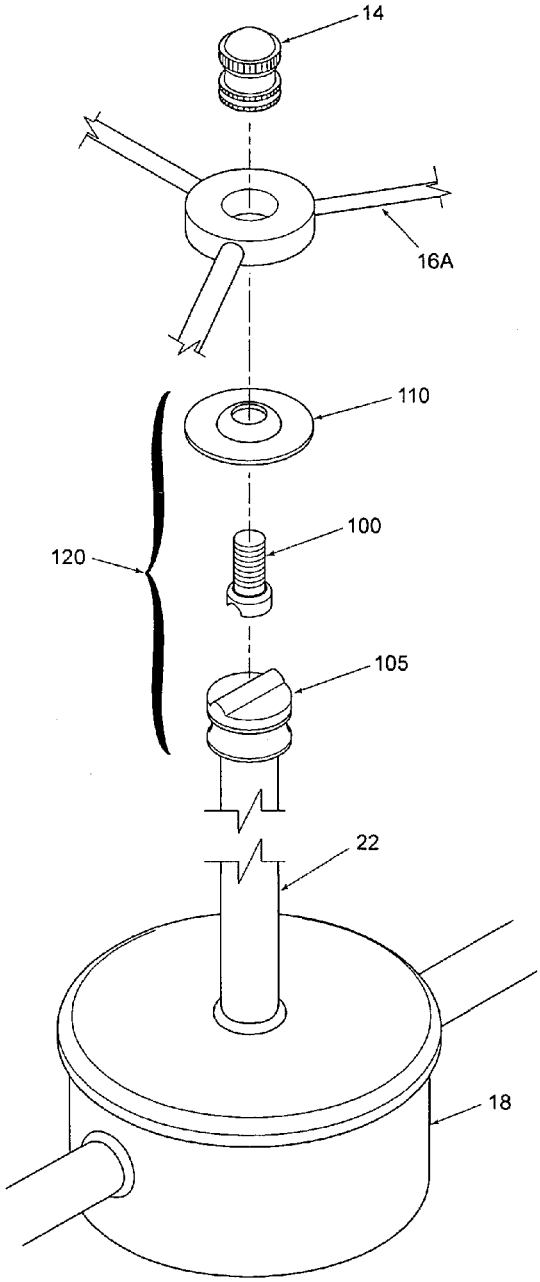
FIGS. 14A and 14B are diagrams illustrating the components of the shade leveler from FIG. 13 according to alternate embodiments of the invention and how those components fit together with relationship to a conventional S-cluster.
Figure 14B:
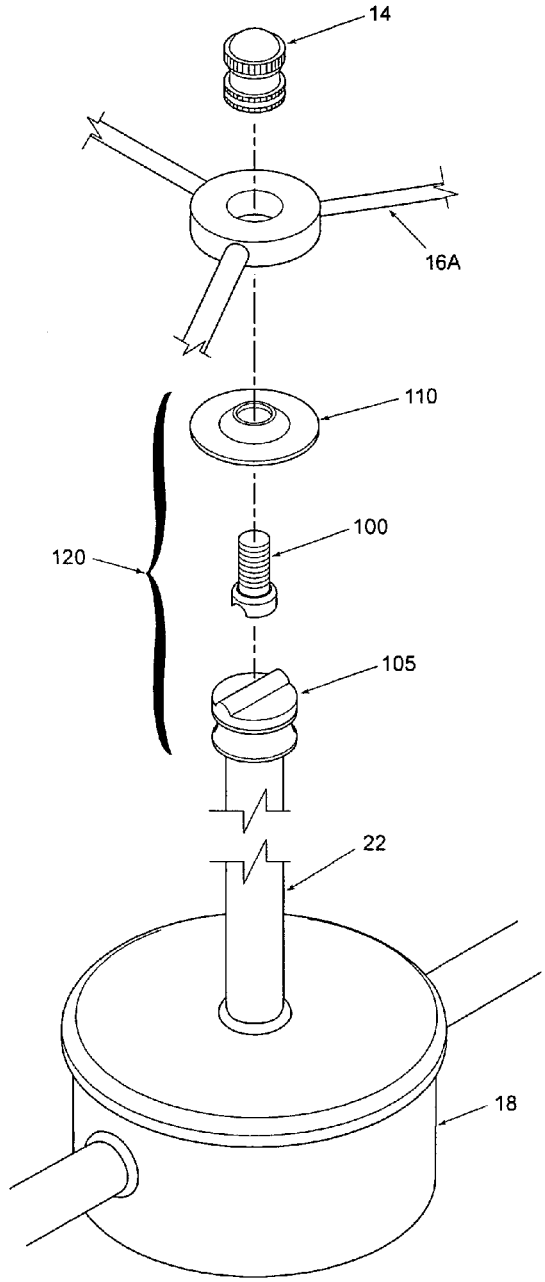

FIGS. 14A and 14B are diagrams illustrating the components of the shade leveler from FIG. 13 according to alternate embodiments of the invention and how those components fit together with relationship to a conventional S-cluster. Like the embodiments described above, the shade leveler 120 includes a post 100 and a shade leveling ring 110.

However, since the conventional S-cluster does not use a harp, the shade leveler 120 also includes a base 105 that has a ridge on top of it. The base 105 is affixed to the top of the riser 22. Like the embodiments explained above, the grooved bottom portion of the post 100 and the ridge on the base 105 interface with each other and allow the finial 14 to be tightened and loosened without turning the post 100. As usual, a conventional shade bracket 16A is held on the post 100 by a conventional finial 14.

While both of the shade leveling rings 110 in FIGS. 14A and 14B are substantially dome-shaped, the shade leveling ring 110 of FIG. 14B has a raised edge at the uppermost portion of the dome, similar to the embodiment illustrated in FIG. 7B.

The base 105, the post 100, and the shade leveling ring 110 may be manufactured from any number of conventionally known materials such as metals, plastics, ceramics, or wood.

Figure 15A:
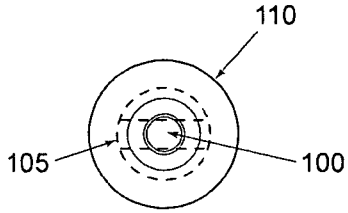
FIGS. 15A-15C are top, front, and side-view diagrams, respectively, that illustrate the components of the shade leveler of FIG. 14A after being assembled and affixed to a conventional riser.
Figure 15B:
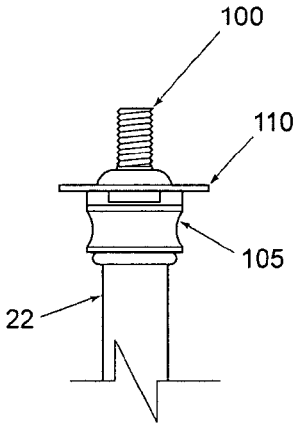
Figure 15C:
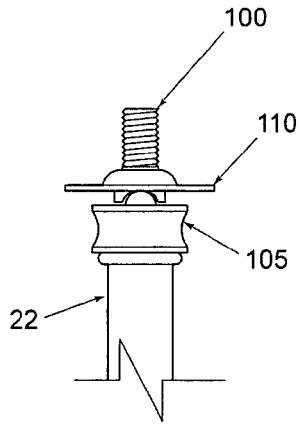

FIGS. 15A-15C are top, front, and side-view diagrams, respectively, that illustrate the components of the shade leveler of FIG. 14A after being assembled and affixed to the riser 22. A flat, outer portion of the shade leveling ring 110 contacts the ridge on the base 105. At this junction the shade leveling ring 110 may be permanently or detachably affixed to the base 105. The contact point between the shade leveling ring 110 and the base 105 is analogous to the contact point between the shade leveling ring 110 and the harp 8 illustrated in FIGS. 8A-8C. The shade leveling ring 110 holds the post 100 loosely against base 105. In other words, no portion of the post is rigidly connected to the base 105. The entire shade leveler 120, once assembled, may be permanently or detachably affixed to the riser 22. The shade leveling ring 110 may be permanently affixed to the base 105 by any number of conventional methods, such as spot welding. The shade leveling ring 110 may also be detachably affixed to the base 105 using any number of conventional methods, such as adhesive or screws.

While the embodiments of the invention described in FIGS. 13, 14, and 15 include an additional component (the base 105) compared to the other embodiments described in this disclosure, the operation of these embodiments is substantially the same as the operation explained above with respect to FIGS. 10 and 11. Thus, for the sake of brevity, the operation of the embodiments illustrated in FIGS. 13, 14, and 15 will not be duplicated here.

FIGS. 16A and 16B are top-view diagrams illustrating an additional component for a shade leveler according to still other embodiments of the invention. FIGS. 16A and 16B illustrate a finial ring 115. The finial ring 115 has a rectangular slot 116. The slot 116 is configured to allow the post 100 to pass through the center of the finial ring 115.

FIGS. 17A and 17B are side-view diagrams corresponding to FIGS. 16A and 16B, respectively, illustrating how the finial ring 115 of FIGS. 16A and 16B is assembled in relationship to other components of the shade leveler. The shade leveling ring 110 holds the post 100 against a harp (not shown). Unlike the embodiments illustrated in FIGS. 6-11, in this case the shade leveling ring 110 is rigidly affixed to the post 100. That is, the shade leveling ring 110 and the post 100 cannot move in relation to each other.

Like the other embodiments described above, a finial 14 is threaded on the post 100 to hold a shade bracket 16A against the dome-shaped portion of the shade leveling ring 110. However, in this case the finial ring 115 is inserted between the shade bracket 16A and the finial 14. The finial ring 115 also has a dome-shaped profile. The dome-shaped profile of the finial ring may or may not be the same as the dome-shaped profile of the shade leveling ring 110.

The finial ring 115 allows the shade bracket 16A to pivot on top of the shade leveling ring 110 even when the post 100 is rigidly affixed to the shade leveling ring 110. The rectangular slot 116 in the finial ring 115 allows the finial ring to move in relationship to the fixed post 100. Without the finial ring 115, the flat bottom surface of the finial 14 would otherwise contact the flat upper surface of the shade bracket 16A, preventing it from sliding on the dome-shaped upper surface of the shade leveling ring 110.

It should be apparent that in the embodiments described in FIGS. 16A, 16B, 17A, and 17B, the range of motion for the shade bracket 16A is additionally limited by the shape of the rectangular slot 116. In other embodiments of the invention, the shape of the slot 116 in the finial ring 115 may be different to allow for other desired ranges of motion. For example, the rectangular slot 116 could be replaced with a circular hole with a diameter larger than that of the post 100. This would allow movement of the shade bracket 16A in all directions. Alternatively, the opening in the finial ring 115 could be cross-shaped or star-shaped.

Figure 18:
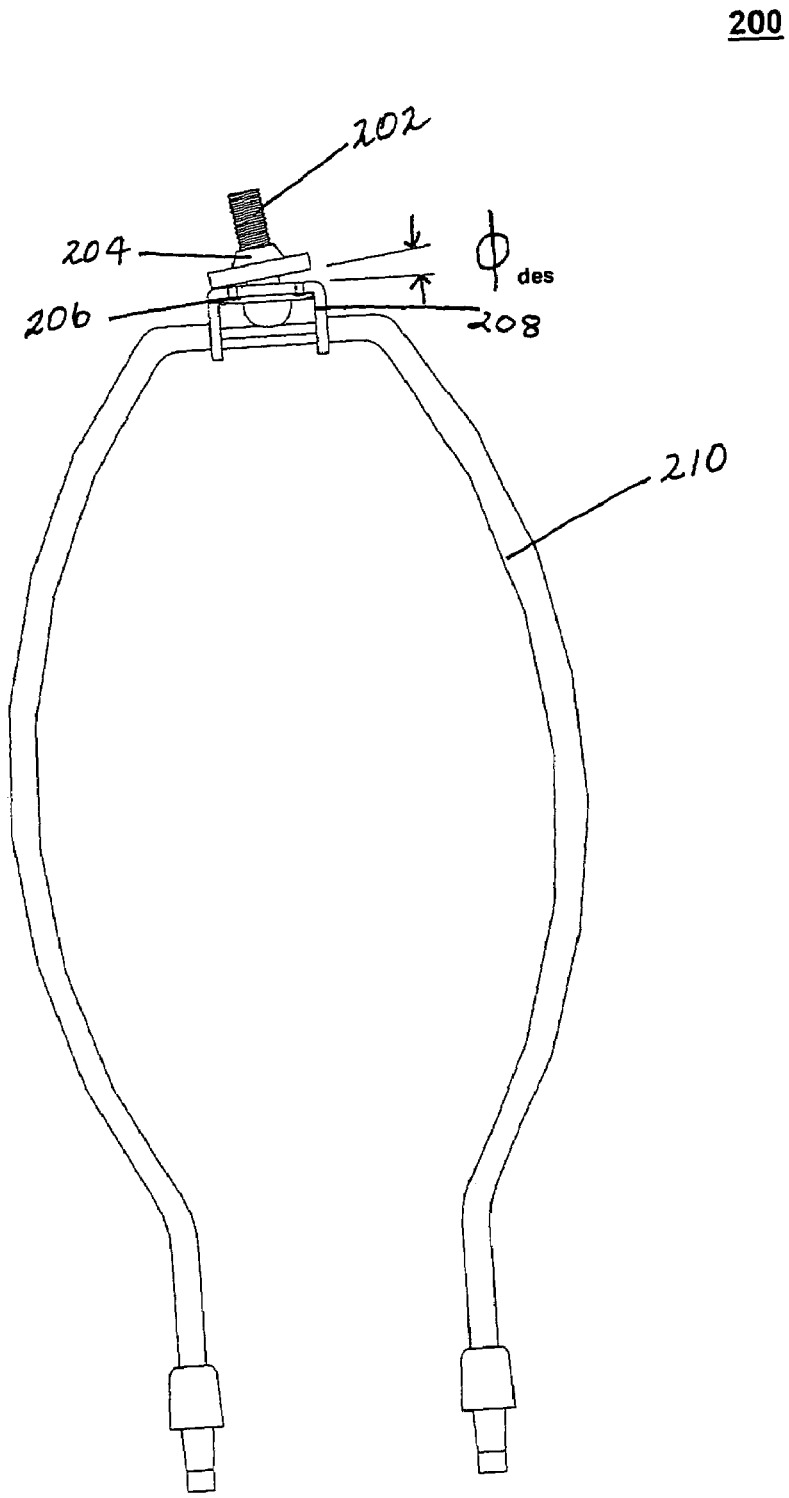
FIG. 18 is a side-view diagram illustrating a shade leveler according to some other embodiments of the invention.
Figure 19:
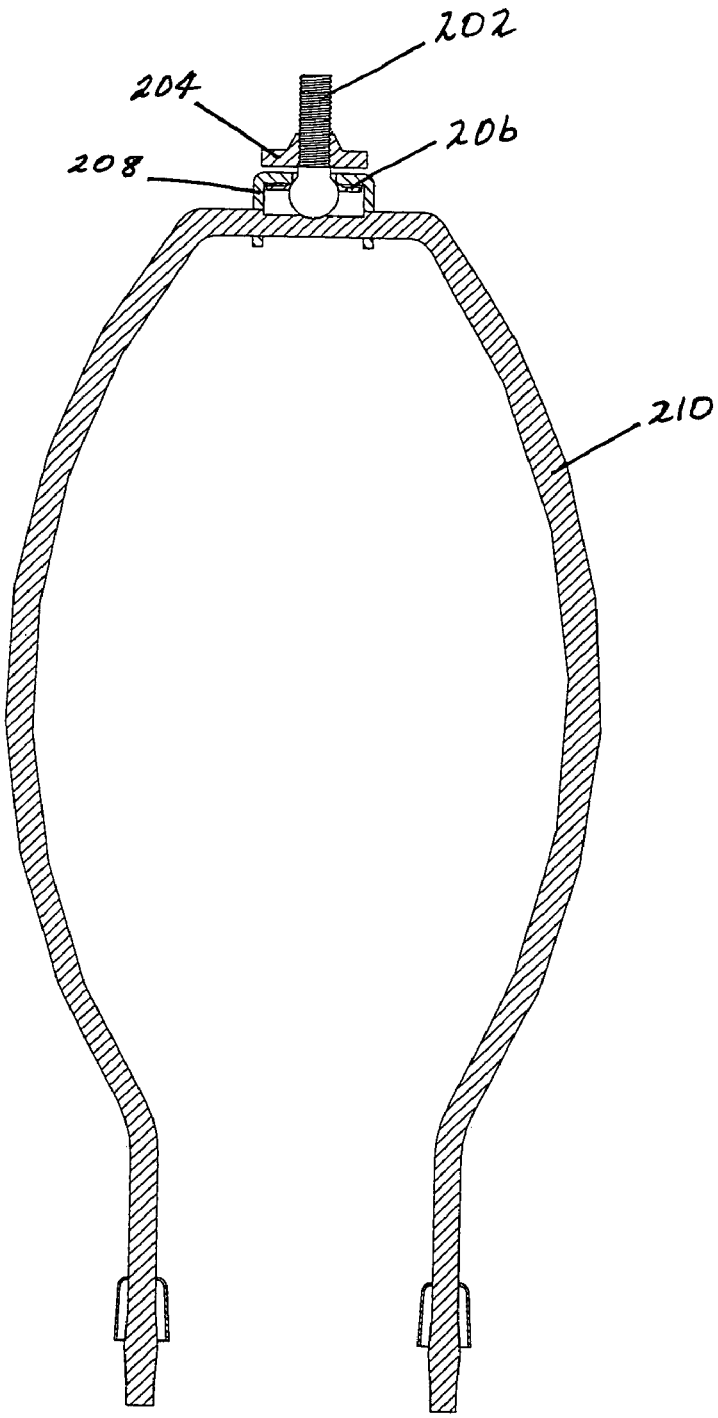
FIG. 19 is a side-view diagram further illustrating the components of the shade leveler of FIG. 18, where some components are illustrated in cross-section.
Figure 20:
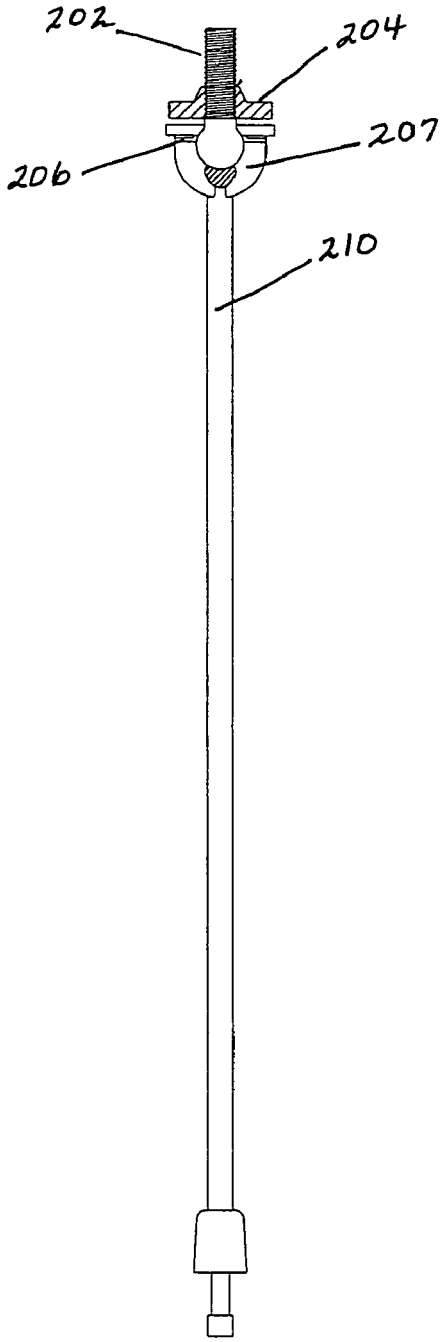
FIG. 20 is a side-view diagram further illustrating the components of the shade leveler of FIG. 18, where some components are illustrated in cross-section.

FIG. 18 is a side-view diagram illustrating a shade leveler 200 according to some other embodiments of the invention. FIGS. 19 and 20 are side-view diagrams further illustrating the components of the shade leveler 200, where some components are illustrated in cross-section. In FIGS. 18, 19, and 20, conventional features such as a lamp, lampshade, and finial are not illustrated to avoid obscuring the inventive aspects of the illustrated embodiments.

Referring to FIGS. 18, 19, and 20, the shade leveler 200 includes a ball head bolt 202, a seat ring 204, a tension spring 206, a bracket 208, and a harp rod 210. As is more easily seen in FIGS. 19 and 20, the ball head bolt 202 (which is not shown in cross-section) has a threaded portion like a conventional bolt, but the head of the bolt is in the shape of a sphere or a ball. The bracket 208 is clamped to the harp rod 210 on either side of the ball head bolt 202 and holds the ball head bolt 202 against the top of the harp rod 210.

Preferably, the portion of the harp rod 210 that is in contact with the ball of the ball head bolt 202 has a concave indentation to better support the convex surface of the ball head bolt 202, but this feature is not required. The concave indentation may be formed by stamping the harp rod 210 or by some other conventional technique.

The seat ring 204 is structured to be threaded on the threaded portion of the ball head bolt 202, and provides the surface upon which the conventional lampshade rests. The threaded portion of the ball head bolt 202 is also structured to accept a conventional finial, so that the conventional lampshade may be held firmly against the seat ring 204. The tension spring 206 is arranged such that it is in contact with an upper surface of the spherical portion of the ball head bolt 202, and in contact with a lower surface of the bracket 208.

Figure 21:
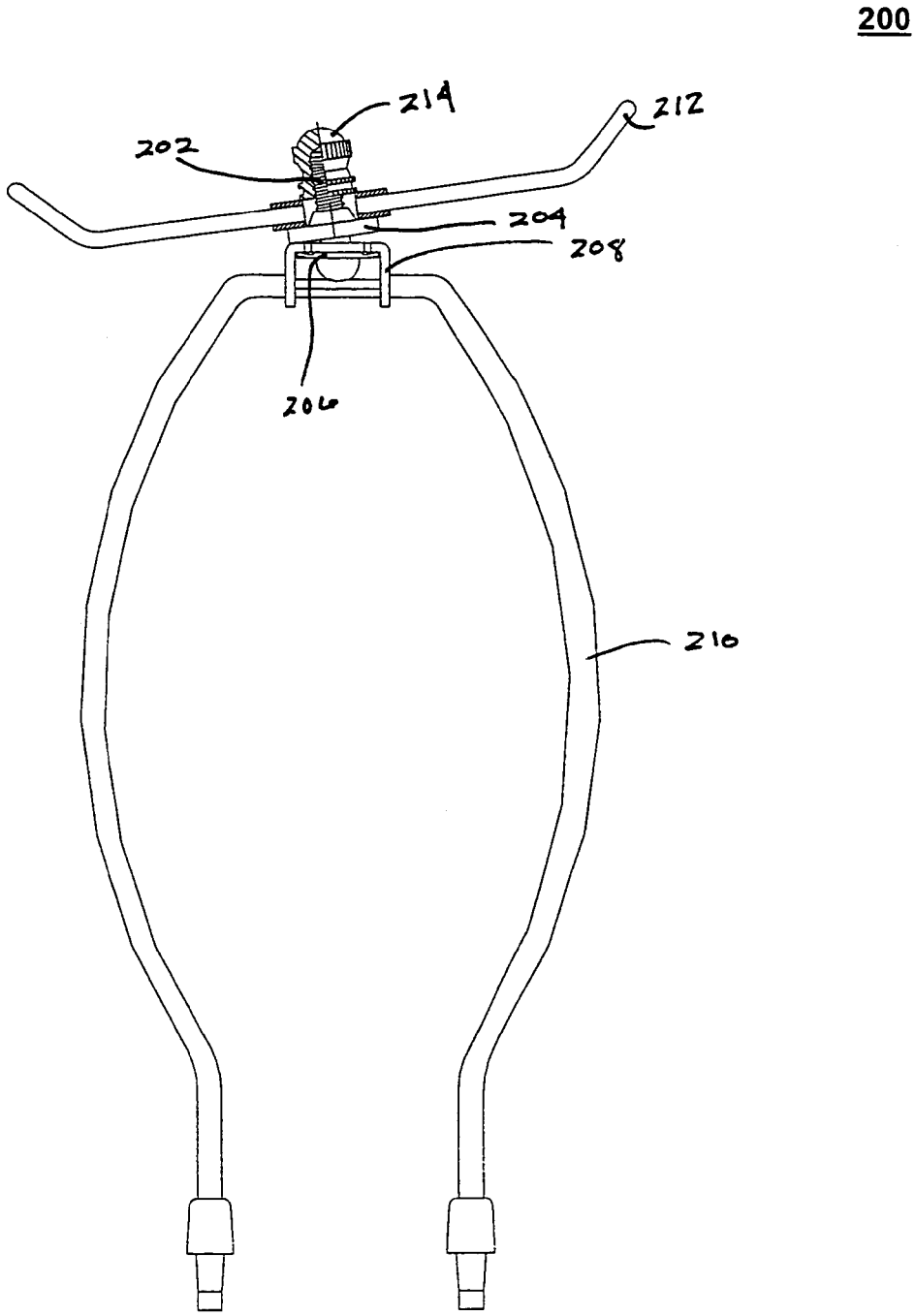
FIG. 21 is a side-view diagram illustrating the operation of the shade leveler of FIG. 18 in conjunction with a conventional lampshade and a conventional finial.

FIG. 21 is a side-view diagram illustrating the operation of the shade leveler 200 in conjunction with a conventional lampshade 212 and a conventional finial 214. For clarity, only a portion of the lampshade 212 is shown in FIG. 21. According to preferred embodiments of the invention, the upper surface of the seat ring 204 may be dome or cone-shaped as seen in FIGS. 18-21, so that the lampshade 212 is automatically centered on the seat ring 204 as the finial 214 is tightened on the lampshade.

As is shown in FIGS. 18 and 21, the lamp shade leveler 200 is structured to tilt $\phi$ degrees away from a vertical axis. This tilt may occur at any angular position (i.e., 360°) around the vertical axis. The amount of tilt $\phi$ is determined by the interaction of the ball head bolt 202, the seat ring 204, and the bracket 208.

The bracket 208 holds the ball head bolt 202 against an upper surface of the harp rod 210, but does not maintain the ball head bolt in a rigid relationship with the harp rod. That is, the opening of the bracket 208 where the ball head bolt 202 passes through the bracket is preferably larger than the diameter of the shaft of the ball head bolt. This allows the entire ball head bolt 202 to be tilted relative to the vertical axis, and the ball head portion of the ball head bolt to rotate where it is cupped by the concave portion of the harp rod 210. Of course, if the seat ring 204 were not threaded on the ball head bolt 202, the shaft of the ball head bolt 202 would, at some point, contact the opening in the bracket 208 and prevent the ball head bolt 202 from tilting any further away from the vertical axis. This maximum tilt limit arising only from the contact between the ball head bolt 202 and the bracket 208 will be referred to as $\phi_{max1}$.

The seat ring 204 is structured to be threaded on the end of the ball head bolt 202, and it should be apparent that the position of the seat ring on the ball head bolt may be adjusted by turning the seat ring counterclockwise or clockwise. Preferably, the seat ring 204 is positioned such that the bottom surface of the seat ring is parallel to an upper surface of the bracket 208, but not in direct contact with the upper surface. Otherwise, the lamp shade leveler 200 could not achieve any tilt. Thus, the seat ring 204 is positioned on the ball head bolt 202 such that there is a non-zero separation between the seat ring and the bracket 208 when the bottom surface of the seat ring and the upper surface of the bracket are aligned parallel to each other. However, at one particular position of the seat ring 204, the seat ring will begin to contact the bracket 208 when the ball head bolt 202 is at the maximum tilt position $\phi_{max1}$. At this position of the seat ring 204, the maximum tilt becomes limited by the contact between the seat ring and the bracket 208, not by the contact between the ball head bolt 202 and the bracket. The maximum tilt limit arising only from the contact between the seat ring 204 and the bracket 208 will be referred to as $\phi_{max2}$. In most cases, As the distance between the parallel surfaces of the seat ring 204 and the bracket 208 becomes smaller, the amount of tilt $\phi$ that may be achieved by the shade leveler 200 becomes smaller as well.

In the illustrated embodiments, the threaded portion of the ball head bolt 202 is designed to limit the minimum separation between the parallel surfaces of the seat ring 204 and the bracket 208. This minimum separation corresponds to a design tilt limit that will be referred to as $\phi_{des}$. Thus, in the illustrated embodiments, when the seat ring 204 is in its lowest position on the ball head bolt 202, the amount of tilt $\phi$ that the shade leveler 200 can achieve is between 0° and $\phi_{des}$ ($0° \leqq \phi \leqq \phi_{des}$). In preferred embodiments of the invention, the design tilt limit $\phi_{des}$ is about 8°. In alternative embodiments, the design tilt limit $\phi_{des}$ may be smaller than 8°. Of course, a tilt that is greater than the design tilt limit $\phi_{des}$ may be achieved if the seat ring 204 is not placed in a position corresponding to the minimum separation between the parallel surfaces of the seat ring 204 and the bracket 208.

As was indicated above, the tension spring 206 is arranged in contact with an upper surface of the spherical portion of the ball head bolt 202 and in contact with a lower surface of the bracket 208. The tension spring 206 is structured such that it pushes against the lower surface of the bracket 208, firmly seating the convex surface of the spherical portion of the ball head bolt 202 into the concave indentation on the harp rod 210. However, the tension spring 206 is also structured such that the convex surface of the spherical portion of the ball head bolt 202 may slide against the concave indentation on the harp rod 210. Preferably, the tension spring 206 does not provide a sufficient force to prevent a conventional lampshade attached to the shade leveler 200 from being placed in a desired position by applying an outside force to the shade leveler. This is what would occur, for example, if a person wished to change the position of the shade. On the other hand, the tension spring 206 does provide a sufficient force to prevent the conventional lampshade from moving due to the force of gravity.

Thus, using the shade leveler 200, a person could tilt a conventional shade 212 attached to the shade leveler up to $\phi_{des}$ away from the horizontal plane, and the tilt may be in any direction (360°) around a vertical axis that is perpendicular to the horizontal plane.

Furthermore, because the shade leveler 200 allows a tilt of up to ides in all directions around the vertical axis, the shade leveler may prevent the lampshade 212 from being damaged or the lamp from being knocked over when a displacing force is applied. According to preferred embodiments of the invention, the tension spring 206 may include spring steel, although other flexible or semi-flexible materials may be used.

The use of the tension spring 206 is also advantageous in embodiments of the invention because it may prevent metal-to-metal contact between the spherical portion of the ball head bolt 202 and the bracket 208. Without the tension spring 206, the connection between the ball head bolt 202 and the bracket 208 would become increasingly loose, requiring constant re-adjustment of the lampshade 212 position or replacement of the lamp shade leveler.

Figure 22A:
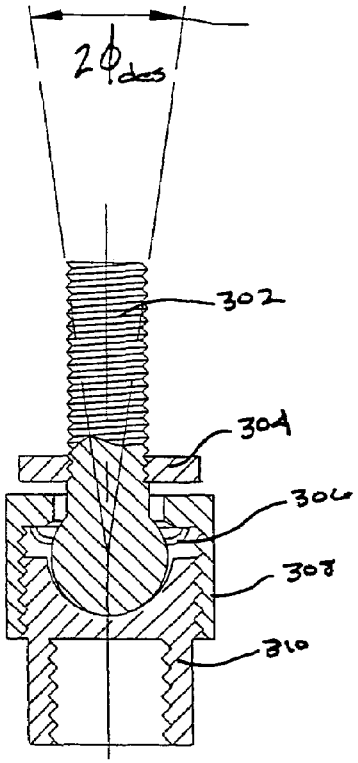
FIG. 22A is a cross-sectional diagram illustrating a shade leveler according to some other embodiments of the invention.
Figure 22B:
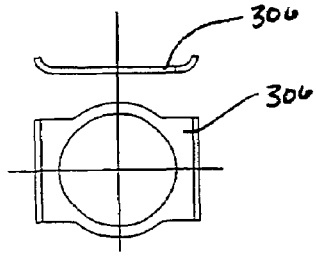
FIG. 22B is a top-view and a side-view diagram further illustrating the tension spring of FIG. 21A.
Figure 22C:
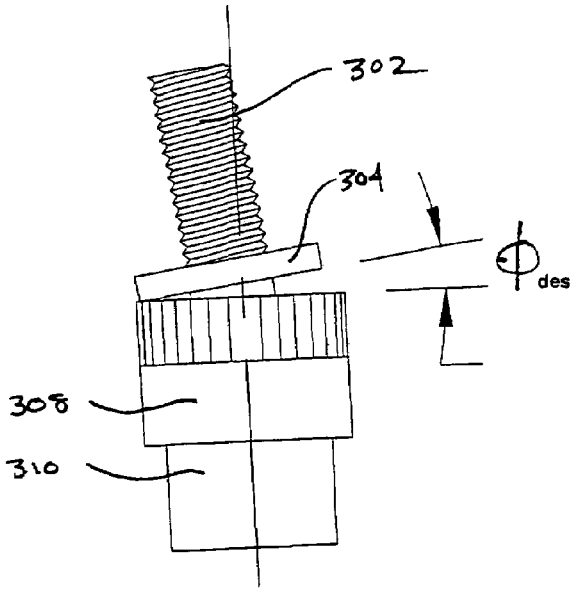
FIG. 22C is a side view diagram illustrating the operation of the shade leveler of FIG. 22A.
Figure 23:
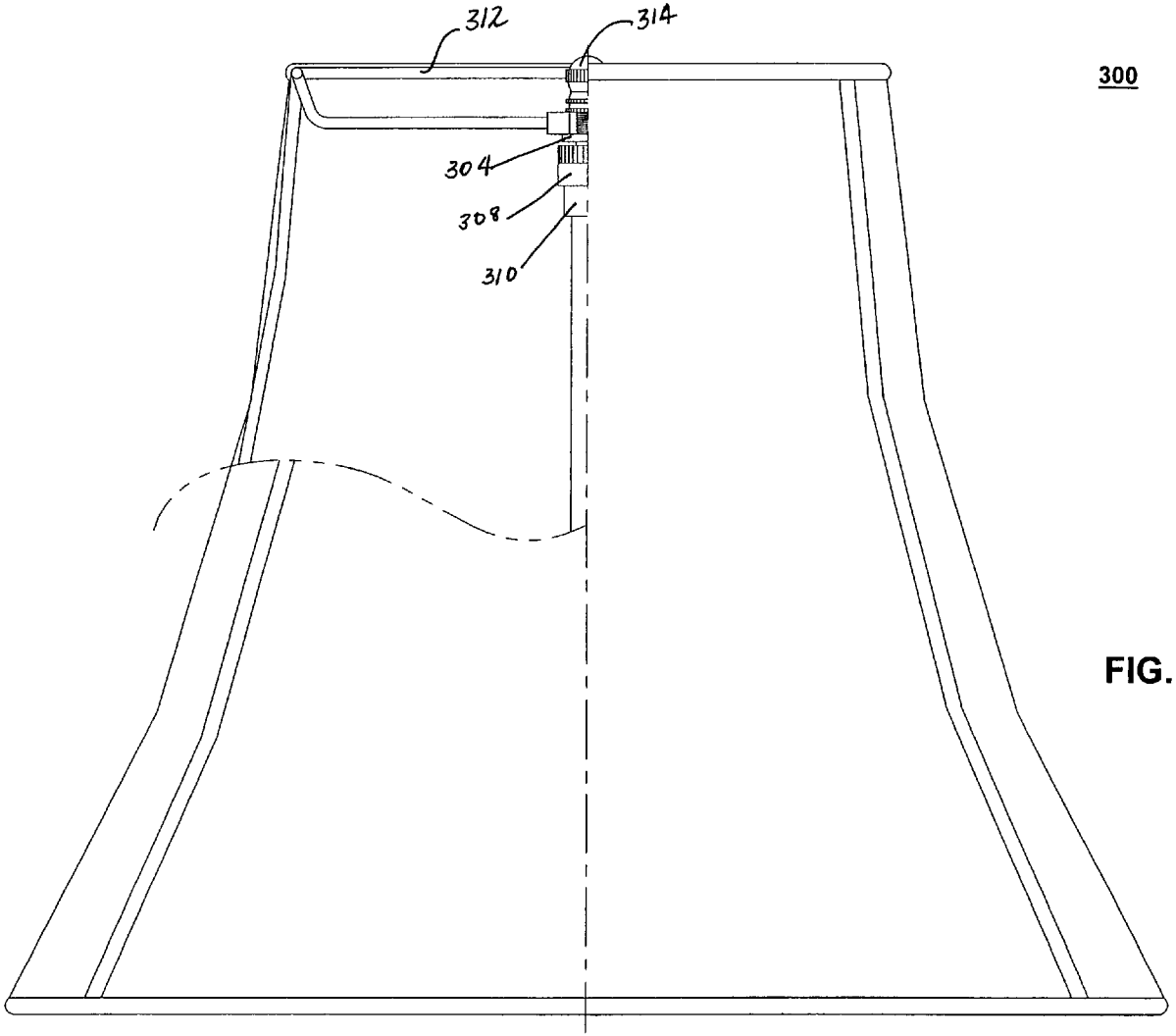
FIG. 23 is a side-view diagram illustrating the shade leveler of FIG. 22A assembled in conjunction with a conventional lampshade and a conventional finial.
Figure 24:
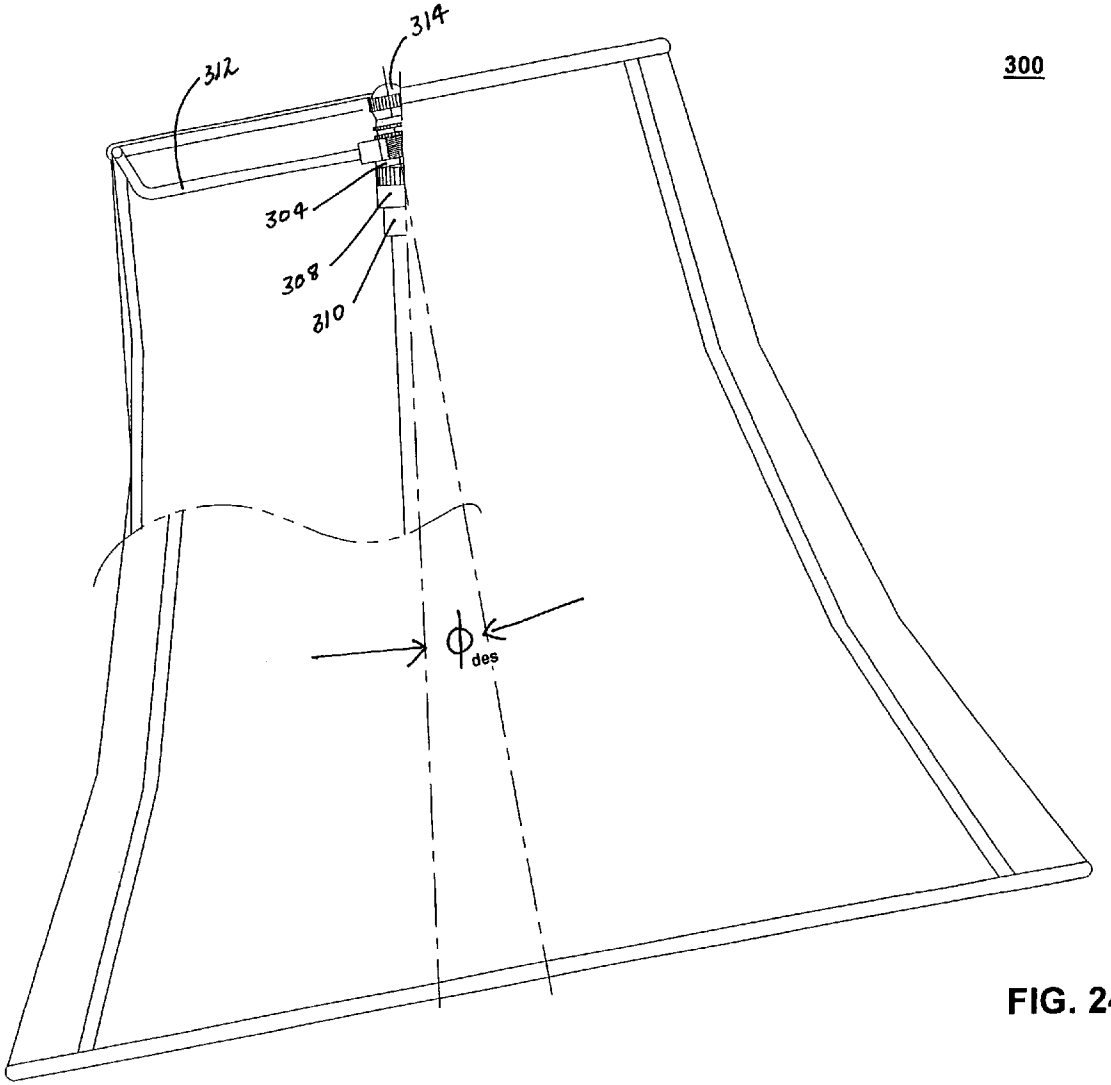
FIG. 24 is a side-view diagram illustrating the shade leveler of FIG. 22A operating in conjunction with the conventional lampshade and the conventional finial.

FIG. 22A is a cross-sectional diagram illustrating a shade leveler 300 according to some other embodiments of the invention. FIG. 22B is a top-view and a side-view diagram further illustrating the tension spring of FIG. 22A. FIG. 22C is a side view diagram illustrating the operation of the shade leveler 300. FIG. 23 is a side-view diagram illustrating the shade leveler 300 assembled in conjunction with a conventional lampshade and a conventional finial. FIG. 24 is a side-view diagram illustrating the shade leveler 300 operating in conjunction with the conventional lampshade and the conventional finial.

In operation, the shade leveler 300 is very similar to the shade leveler 200 illustrated in FIGS. 18-21. One difference, however, is that the shade leveler 300 is structured to fit on the end of a pipe, for example, a pipe such as the riser 22 illustrated in FIGS. 13A and 13B. Thus, the embodiments of the invention illustrated in FIG. 22A may be used in conjunction with a conventional S-cluster, for example, the S-cluster 20 of FIGS. 13A and 13B.

Referring to FIGS. 22A, 22B, 22C, 23, and 24, the shade leveler 300 includes a ball head bolt 302, a seat ring 304, a tension spring 306, and a threaded cap 308. The shade leveler may further include a pipe coupling 310. The pipe coupling 310 has an upper surface with a substantially concave indentation. The pipe coupling 310 has radially inward-facing threads that are configured engage radially outward-facing threads (not shown) on the end of a pipe or cylinder. The diameter of the hole containing the radially inward-facing threads in the pipe coupling 310 may vary to accommodate any size pipe.

Functionally, the threaded cap 308 serves a similar purpose as the bracket 208 of FIGS. 18-21. The threaded cap 308 has radially inward-facing threads arranged around an inner diameter of the threaded cap 308. The radially inward-facing threads are structured to engage radially outward-facing threads arranged around an outer diameter of the pipe coupling 310. When the threaded cap is 308 is screwed on to the pipe coupling 310, it holds a spherical portion end of the ball head bolt 302 within the corresponding concave indentation at the upper end of the pipe coupling 310.

As illustrated in FIG. 22A, according to some embodiments of the invention the seat ring 304 may have a top surface that is substantially flat.

As illustrated in FIG. 22C, the shade leveler 300 is structured to tilt $\phi$ degrees away from a vertical axis. This tilt may occur at any angular position (i.e., 360°) around the vertical axis. The amount of tilt $\phi$ is determined by the interaction of the ball head bolt 302, the seat ring 304, and the threaded cap 308.

The threaded cap 308 holds the ball head bolt 302 against an upper surface of the harp rod 210, but does not maintain the ball head bolt in a rigid relationship with the harp rod. That is, the opening of the threaded cap 308 where the ball head bolt 302 passes through the threaded cap 308 is preferably larger than the diameter of the shaft of the ball head bolt. This allows the entire ball head bolt 302 to be tilted relative to the vertical axis, and the ball head portion of the ball head bolt to rotate where it is cupped by the concave portion of the pipe coupling 310. Of course, if the seat ring 304 were not threaded on the ball head bolt 302, the shaft of the ball head bolt would, at some point, contact the opening in the threaded cap 308 and prevent the ball head bolt 302 from tilting any further away from the vertical axis. This maximum tilt limit arising only from the contact between the ball head bolt 302 and the threaded cap 308 will be referred to as $\phi_{max1}$.

The seat ring 304 is structured to be threaded on the end of the ball head bolt 302, and it should be apparent that the position of the seat ring on the ball head bolt may be adjusted by turning the seat ring counterclockwise or clockwise. Preferably, the seat ring 304 is not positioned such that the bottom surface of the seat ring is parallel to and in direct contact with an upper surface of the threaded cap 308. Otherwise, the lamp shade leveler 300 could not achieve any tilt. Thus, the seat ring 304 is preferably positioned on the ball head bolt 302 such that there is a non-zero separation between the seat ring and the threaded cap 308 when the bottom surface of the seat ring and the upper surface of the threaded cap are aligned parallel to each other. However, at one particular position of the seat ring 304, the seat ring will begin to contact the threaded cap 308 when the ball head bolt 302 is at the maximum tilt position $\phi_{max1}$. At this position of the seat ring 304, the maximum tilt becomes limited by the contact between the seat ring and the threaded cap 308, not by the contact between the ball head bolt 302 and the threaded cap. The maximum tilt limit arising only from the contact between the seat ring 304 and the threaded cap 308 will be referred to as $\phi_{max2}$.

As the distance between the parallel surfaces of the seat ring 304 and the threaded cap 308 becomes smaller, the amount of tilt $\phi$ that may be achieved by the shade leveler 300 becomes smaller as well. In the illustrated embodiments, the threaded portion of the ball head bolt 302 is designed to limit the minimum separation between the parallel surfaces of the seat ring 304 and the threaded cap 308. This minimum separation corresponds to a design tilt limit that will be referred to as $\phi_{des}$. Thus, in the illustrated embodiments, when the seat ring 304 is in its lowest position on the ball head bolt 302, the amount of tilt $\phi$ that the shade leveler 300 can achieve is between 0° and $\phi_{des}$ ($0° \leqq \phi \leqq \phi_{des}$). In preferred embodiments of the invention, the design tilt limit $\phi_{des}$ is about 8°, but in other embodiments the design tilt limit may be less than that.

Similar to the embodiments illustrated in FIGS. 18-21, the tension spring 306 is arranged in contact with an upper surface of the spherical portion of the ball head bolt 302 and in contact with a lower surface of the threaded cap 308. The tension spring 306 is structured such that it pushes against the lower surface of the threaded cap 308, firmly seating the convex surface of the spherical portion of the ball head bolt 302 into the concave indentation on the pipe coupling 310. However, the tension spring 306 is also structured such that the convex surface of the spherical portion of the ball head bolt 302 may slide against the concave indentation on the pipe coupling 310. Preferably, the tension spring 306 does not provide a sufficient force to prevent a conventional lampshade 312 attached to the shade leveler 300 from being placed in a desired position by applying an outside force to the shade leveler. This is what would occur, for example, if a person wished to change the position of the shade. On the other hand, the tension spring 306 does provide a sufficient force to prevent the conventional lampshade from moving due to the force of gravity.

Thus, using the shade leveler 300, a person could tilt a conventional shade 312 attached to the shade leveler up to $\phi_{des}$ away from the horizontal plane, and the tilt may be in any direction (360°) around a vertical axis that is perpendicular to the horizontal plane.

Furthermore, because the shade leveler 300 allows a tilt of up to $\phi_{des}$ in all directions around the vertical axis, the shade leveler may prevent the lampshade 312 from being damaged or the lamp from being knocked over when a displacing force is applied (e.g., the lampshade is accidentally struck by another object). According to preferred embodiments of the invention, the tension spring 306 may include spring steel, although other flexible or semi-flexible materials may be used.

Referring to FIG. 22B, it can be seen that the tension spring 306 has a circular opening. The diameter of the opening is large enough to allow the shaft portion of the ball head bolt 302 to pass through it, but is small enough to prevent the spherical portion of the ball head bolt from passing through it. The turned up edges of the tension spring 306 do not completely surround the opening, but are disposed on opposite sides of the spring and are substantially parallel to each other.

Other shapes for the tension spring 306 are anticipated. For example, the edge of the tension spring 306 that contacts the surface of the threaded cap 308 may be continuous, circular, and completely surround the opening. In other embodiments of the invention, the edge that contacts the threaded cap 408 may be continuous but have an irregular polygonal shape or a regular polygonal shape such as square, pentagonal, hexagonal, octagonal, etc. In other embodiments, the curved edges of the tension spring 306 may not be continuous but may have multiple curved edge portions that are separated by edges that are substantially flat.

According to preferred embodiments of the invention, the tension spring 306 consists of spring steel, but it is anticipated that other flexible materials may alternatively be used, either alone or in combination.

According to the illustrated embodiments of the invention the tension spring is also advantageous in that it prevents metal-to-metal contact between the spherical portion of the ball head bolt 302 and the threaded cap 308. Without the tension spring 306, the connection between the ball head bolt 302 and the threaded cap 308 would become increasingly loose, requiring constant re-adjustment of the position of the lampshade 312 or replacement of the lamp shade leveler 300.

Figure 25A:
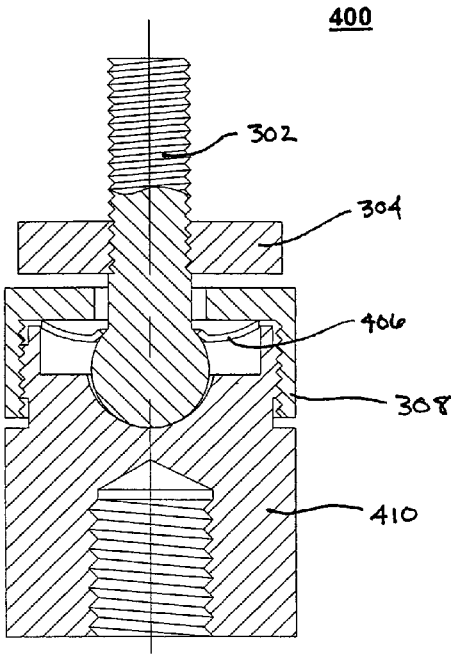
FIG. 25A is a cross-sectional diagram illustrating a shade leveler 400 according to some other embodiments of the invention.
Figure 25B:
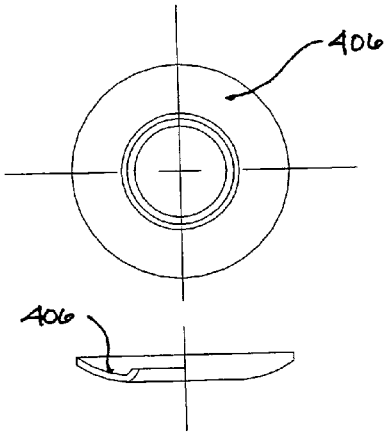
FIG. 25B is a top-view and a side-view diagram further illustrating the tension spring 406 of FIG. 25A.
Figure 25C:
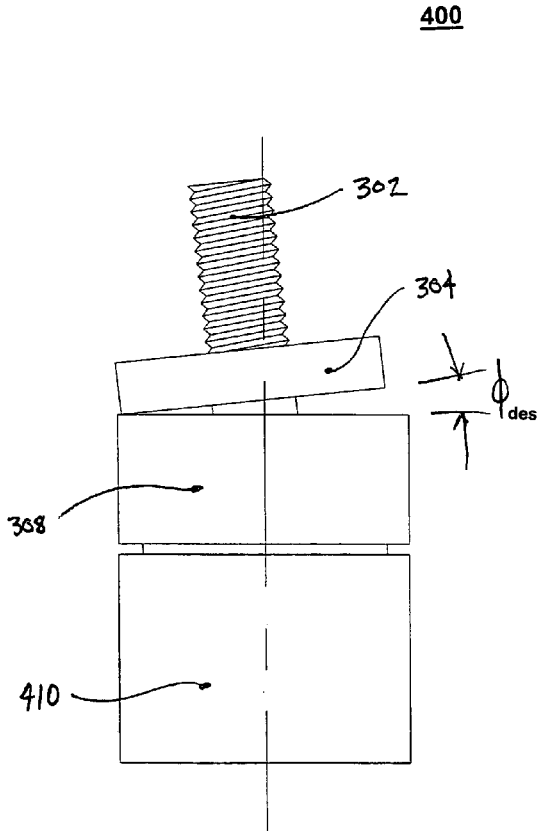
FIG. 25C is a side view diagram illustrating the operation of the shade leveler 400.

FIG. 25A is a cross-sectional diagram illustrating a shade leveler 400 according to some other embodiments of the invention. FIG. 25B is a top-view and a side-view diagram further illustrating the tension spring 406 of FIG. 25A. FIG. 25C is a side view diagram illustrating the operation of the shade leveler 400.

Referring to FIGS. 25A, 25B, and 25C, the shade leveler includes a ball head bolt 302, a seat ring 304, and a threaded cap 308. These components are the same as those described for the embodiments illustrated in FIGS. 22-24, so a duplicate description will be omitted.

The shade leveler 400 also includes a tension spring 406 and a bolt coupling 410. The bolt coupling 410 includes a hole with radially inward-facing threads that are configured to engage radially outward-facing threads (not shown) of a bolt or a screw. The diameter of the hole containing the radially inward-facing threads of the bolt coupling 410 may be varied to accommodate any size bolt or screw. Like the pipe coupling 310 of FIG. 22A, the bolt coupling 410 has an upper surface with a concave indentation structured to match the convex surface of the spherical head portion of the ball head bolt 302.

Referring to FIGS. 25A and 25B, the tension spring 406 may be a washer with a substantially dome-shaped profile. A central hole in tension spring 406 is sized to allow the shaft of the ball head bolt 302 to pass through it, but is too small to allow the head of the ball head bolt to pass through. Although the shape of the tension spring 406 has a different construction compared to the tension spring 306 of the embodiments described above, functionally the tension spring 406 serves the same purpose.

That is, the tension spring 406 is arranged in contact with an upper surface of the spherical portion of the ball head bolt 302 and in contact with a surface of the threaded cap 308. The tension spring 406 is structured such that it pushes against the surface of the threaded cap 308, firmly seating the convex surface of the spherical portion of the ball head bolt 302 into the concave indentation on the bolt coupling 410. However, the tension spring 406 is also structured such that the convex surface of the spherical portion of the ball head bolt 302 may slide against the concave indentation on the bolt coupling 410. Preferably, the tension spring 406 does not provide a sufficient force to prevent a conventional lampshade attached to the shade leveler 400 from being placed in a desired position by applying an outside force to the shade leveler. This is what would occur, for example, if a person wished to alter the position of the shade. On the other hand, the tension spring 406 preferably provides a sufficient force to prevent an attached conventional lampshade from moving due to the force of gravity.

Over time, metal-to-metal wear between the tension spring 406 and the head of the ball head bolt 302 may require additional force to be applied to the tension spring 406. This is easily accomplished by adjusting the position of the threaded end cap 308 on the bolt coupling 410.

Thus, using the shade leveler 400, a person could tilt a conventional shade attached to the shade leveler up to $\phi_{des}$ away from the horizontal plane, and the tilt may be in any direction (360°) around a vertical axis that is perpendicular to the horizontal plane.

Furthermore, because the shade leveler 400 allows a tilt of up to $\phi_{des}$ in all directions around the vertical axis, the shade leveler may prevent a conventional lampshade from being damaged or the lamp from being knocked over when a displacing force is applied (e.g., the lampshade is accidentally struck by another object). According to preferred embodiments of the invention, the tension spring 406 may include spring steel, although other flexible or semi-flexible materials may be used.

Having described and illustrated the principles of the invention in several exemplary embodiments, it should be apparent that the invention can be modified in arrangement and detail without departing from such principles. The inventor regards the subject matter of the invention to include all combinations and sub-combinations of the various elements, features, functions and/or properties disclosed herein. The inventor claims all modifications and variations falling within the spirit and scope of the attached claims.

The invention claimed is:

1. A shade leveling device comprising:

a ball head bolt with a spherical portion, a shaft portion, and radially outward-facing threads disposed on the shaft portion, a diameter of the spherical portion greater than a diameter of the shaft portion, the radially outward-facing threads on the shaft portion structured to engage a finial;

a seat ring having a first opening with radially inward-facing threads, the radially inward-facing threads of the seat ring structured to engage the radially outward-facing threads of the shaft portion of the ball head bolt;

an attachment device having a second opening, the second opening structured such that the shaft portion of the ball head bolt may be inserted through the second opening and not contact the attachment device; and a spring having a third opening, the spring structured to prevent the spherical portion of the ball head bolt from contacting the attachment device when the shaft portion of the ball head bolt is inserted through the second opening and the third opening.

2. The shade leveling device of claim 1, the attachment device comprising a bracket that is structured to be clamped to a harp rod.

3. The shade leveling device of claim 1, the seat-ring having a dome-shaped profile.

4. The shade leveling device of claim 1, the attachment device comprising an end-cap having threads arranged around an inner diameter of the end-cap.

5. The shade leveling device of claim 4, the attachment device further comprising a coupling having threads arranged around an outer diameter of the coupling, the threads on the coupling structured to engage the threads on the end-cap.

6. The shade leveling device of claim 5, the coupling having a concave surface that is structured to abut a convex surface of the spherical portion of the ball head bolt.

7. The shade leveling device of claim 1, the tension spring comprising spring steel.

8. A device configured for use with a lighting fixture, the device comprising:

a bolt with a head and a shaft, the shaft having a first set of threads that face radially outwards, the head being substantially spherical, the first set of threads structured to engage a second set of threads that are disposed on a finial;

a seat ring having a third set of threads that are arranged radially inwards, the third set of threads structured to engage the first set of threads; and a mechanical coupling structured to attach the bolt to the lighting fixture, the mechanical coupling having a first opening, the mechanical coupling structured such that a longitudinal axis of the bolt can be tilted with respect to a longitudinal axis of the first opening while the bolt remains attached to the lighting fixture;

the tensioning device structured to prevent the head of the bolt from contacting the mechanical coupling when the bolt is attached to the lighting fixture.

9. The device of claim 8, the tensioning device comprising a washer having a substantially dome-shaped profile.

10. The device of claim 9, the tensioning device consisting of spring steel.

11. The device of claim 8, the mechanical coupling and the bolt configured such that a convex surface of the head abuts a concave surface of the mechanical coupling when the shaft of the bolt is inserted through the first opening.

12. A device comprising:

a bolt including a head and a shaft, the bolt having a first longitudinal axis passing through a center of the head and the shaft, the shaft having a first set of threads disposed on a radially outer surface of the shaft, the head having a substantially convex surface;

a nut having a second set of threads disposed on a radially inner surface of the nut, the second set of threads structured to threadably engage the first set of threads; and a coupling structured to attach the bolt to an object, the coupling and the nut structured to maintain the substantially convex surface of the head in an abutting relationship with a substantially concave surface of the object;

the coupling comprising a first opening having a second longitudinal axis passing through the center of the first opening, the first opening structured to surround the shaft of the bolt, the coupling and the bolt structured such that that the first longitudinal axis can be angularly displaced with respect to the second longitudinal axis when the shaft of the bolt is surrounded by the first opening.

13. The device of claim 12, further comprising a spring structured to abut the bolt and to abut the coupling when the bolt is attached to the object, the spring structured to maintain the first longitudinal axis of the bolt in an angularly displaced position relative to the second longitudinal axis of the first opening when the shaft of the bolt is surrounded by the first opening, when the nut is positioned on the bolt, and when the nut is supporting the weight of a conventional lampshade.

14. The device of claim 13, the spring comprising a washer having a dome-shaped profile.

15. The device of claim 14, the washer consisting of spring steel.

16. The device of claim 12, the nut comprising:

a first surface that is substantially flat; and a second surface disposed opposite the first surface, wherein the second surface is substantially cone-shaped.

* * * * *